US010947848B2

(12) United States Patent
Richardson et al.

(10) Patent No.: US 10,947,848 B2
(45) Date of Patent: Mar. 16, 2021

(54) DIRECT PORT COMMUTATOR AND MANIFOLD ASSEMBLY

(71) Applicant: Parker-Hannifin Corporation, Cleveland, OH (US)

(72) Inventors: Jason Richardson, Chuckey, TN (US); Taylor Johnson, Johnson City, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 295 days.

(21) Appl. No.: 16/060,062

(22) PCT Filed: Jan. 24, 2017

(86) PCT No.: PCT/US2017/014678

§ 371 (c)(1),
(2) Date: Jun. 7, 2018

(87) PCT Pub. No.: WO2017/132116

PCT Pub. Date: Aug. 3, 2017

(65) Prior Publication Data

US 2018/0371911 A1 Dec. 27, 2018

Related U.S. Application Data

(60) Provisional application No. 62/286,554, filed on Jan. 25, 2016.

(51) Int. Cl.
*F01C 20/14* (2006.01)
*F04C 14/14* (2006.01)
(Continued)

(52) U.S. Cl.
CPC ..... *F01C 20/14* (2013.01); *F04C 2/103* (2013.01); *F04C 11/001* (2013.01); *F04C 14/14* (2013.01);
(Continued)

(58) Field of Classification Search
CPC ..... F01C 20/14; F04C 2/103; F04C 11/001; F04C 14/14; F04C 15/0038; F04C 15/0061; F04C 2230/602
See application file for complete search history.

(56) References Cited

U.S. PATENT DOCUMENTS 4,492,539 A * 1/1985 Specht ..... F04C 14/22 418/171
4,639,202 A * 1/1987 Mahanay ..... F01C 20/22 418/59
(Continued)

FOREIGN PATENT DOCUMENTS

| | | | |
|---|---|---|---|
| EP | 2628951 | * | 8/2013 |
| FR | 1045478 | | 11/1953 |
| WO | WO 2006047241 | | 5/2006 |

OTHER PUBLICATIONS

International Search Report and Written Opinion of PCT/US2017/014678 dated Mar. 28, 2017, 12 pages.

*Primary Examiner* — Charles G Freay
(74) *Attorney, Agent, or Firm* — Renner, Otto, Boisselle & Sklar, LLP

(57) ABSTRACT

A commutator/manifold assembly controls a flow of hydraulic fluid in a hydraulic fluid system. The assembly includes a commutator having an offset design including an inner portion eccentrically encompassed within an outer portion, and offset commutator porting to control the hydraulic flow. A manifold includes manifold ports having a straight configuration by which walls defining the manifold ports run substantially along a longitudinal axis through an entirety of the manifold. The commutator is configured to rotate to sequentially align the commutator porting with differing portions of the manifold ports to control the flow. The commutator porting includes inner ports and outer ports that are isolated from each other by a commutator seal. A
(Continued)

commutator ring has a guiding surface that guides rotation of the commutator. The rotation of the commutator provides a timed flow through the manifold ports straight through the manifold and without any directional flow restriction.

16 Claims, 18 Drawing Sheets

(51) Int. Cl.
*F04C 2/10* (2006.01)
*F04C 11/00* (2006.01)
*F04C 15/00* (2006.01)

(52) U.S. Cl.
CPC ..... *F04C 15/0038* (2013.01); *F04C 15/0061* (2013.01); *F04C 2230/602* (2013.01)

(56) References Cited

U.S. PATENT DOCUMENTS

| | | | | |
|---|---|---|---|---|
| 5,017,101 | A | 5/1991 | White | |
| 5,062,776 | A * | 11/1991 | Dlugokecki | F04C 2/105 418/61.3 |
| 10,215,154 | B2 * | 2/2019 | Gilbert | F04C 14/24 |

* cited by examiner

DIRECT PORT COMMUTATOR AND MANIFOLD ASSEMBLY

RELATED APPLICATIONS

This application is a national stage application pursuant to 35 U.S.C. § 371 of PCT/US2017/014678 filed on Jan. 24, 2017, which claims the benefit of U.S. Provisional Application No. 62/286,554 filed Jan. 25, 2016, which are incorporated herein by reference.

FIELD OF INVENTION

The present invention relates generally to hydraulic motors, and more particularly to timing assemblies including a commutator and a porting manifold having porting for the control of hydraulic fluid flow to a gerotor motor assembly.

BACKGROUND

Hydraulic fluid systems are utilized to generate power in a variety of industries. Mining and drilling equipment, construction equipment, motor vehicle transmission systems, and various other industrial applications employ such hydraulic systems. In hydraulic driving or control, a hydraulic pump pumps hydraulic fluid to a hydraulic motor with an output shaft that drives rotation of an end use element (e.g., wheel axle, gear box, rotating fan, or other suitable usage). The motor output that drives the output shaft is regulated through the control of hydraulic fluid flow through the system.

One type of hydraulic motor assembly is commonly referred as a gerotor motor assembly. In a basic configuration of a hydraulic gerotor motor, a rotating rotor set rotates relative to an outer element or stator. The rotor set may include lobes that rotate against vanes on an inner surface of the stator (or vice versa the stator may have lobes and the rotor set may have vanes). These lobe and vane surface features on the diameter surfaces of the rotor set relative to the stator create variable displacement windows or motor pockets for the entry and exit of hydraulic fluid that is pumped through the motor via the action of a hydraulic fluid pump. Pressure differentials among the windows or motor pockets cause the rotor set to rotate relative to the stator, and such rotation of the rotor set in turn drives the rotation of the output shaft.

The control of fluid flow into the motor pockets is controlled by porting in a timing assembly that typical includes a rotating commutator and a timing manifold. In particular, the rotation of the commutator controls fluid flow through porting in the timing manifold by the sequential alignment of ports in the commutator with ports in the manifold. The commutator may include two sets of ports including high pressure side ports and low pressure side ports that are isolated from each other by a sealing element. The high pressure side provides a forward flow through the manifold into the motor pockets, and the low pressure side provides a return flow from the motor pockets back through the manifold and commutator to complete the hydraulic flow circuit. The rotation of the commutator provides a proper timing of the flow through the manifold to and from specific motor pockets to maintain proper rotation of the motor's rotor set. Generally, therefore, rotational positioning of the commutator causes the porting in the timing manifold to supply different motor pockets with hydraulic fluid in a progressive manner to the rotor set in such a way as to maintain a pressure differential across the correct motor pockets to maintain further motion of the rotor set. In this manner, the flow through the timing manifold results in hydraulic fluid flow being provided to the different motor pockets with precise timing so as to cause a desired resultant rotation of the rotor set of the motor.

For proper rotation of the rotor set, the porting in the manifold must be configured so as to provide effective flow paths between the motor pockets and the commutator ports. Such paths further must provide proper flow paths associated with both the high pressure side and low pressure side relative to the commutator ports as the commutator rotates. In conventional configurations, to provide the precise timing with the requisite flow pathways between the motor pockets and the commutator ports, there tends to be a high angle shift, often up to 90°, in the flow direction between the entry ports on opposite faces of the manifold for the input and output flows relative to the manifold. This 90° change in the direction of the input flow relative to the output flow through the manifold, with such tight cornering in the flow path, provides for a highly restrictive flow path. The high restriction results in significant flow losses and often is accompanied by excessive heat generation, which can wear components in the system. The conventional configuration of the manifold and commutator assembly, therefore, has proven to be less efficient than is desirable.

SUMMARY OF INVENTION

The present invention provides a configuration of a commutator/manifold assembly including a manifold and a commutator, which overcomes the deficiencies of conventional configurations. The commutator has an offset design in which commutator porting is offset relative to a central or rotational axis of the commutator. The offset design of the commutator permits alignment with porting in the manifold having a straight configuration, such that the fluid flow pathways extend substantially straight through the entirety of the manifold in the longitudinal direction without the high angle restriction of conventional configurations. In this manner, flow losses are substantially reduced.

Rotation of the commutator is driven by a drive link and is guided by an outer commutator ring in which the commutator rotates. A pressure differential between outer commutator ports and inner commutator ports drives a flow of hydraulic fluid from the commutator through porting in the manifold having the referenced straight configuration, and ultimately to the motor pockets defined by the gerotor motor components (rotor set and stator). A return flow under the pressure differential flows from gerotor motor components back through the manifold porting to the commutator. In exemplary embodiments, the flow path associated with the outer commutator ports may be on the high pressure side, and the flow path associated with the inner commutator ports may be on the low pressure side, but the pressures may be reversed so as to reverse the flow, thereby reversing the direction of the rotation of the gerotor rotor set.

Based on the rotational position of the commutator, different ports in the manifold are on the high pressure side or the low pressure side. In this manner, the rotation of the commutator provides accurate flow timing with respect to the motor pockets to maintain proper rotation of the rotor set. In addition, the offset nature of the commutator ports permits a direct flow of hydraulic fluid substantially straight through the manifold ports to and from the motor pockets in a longitudinal axial direction without the high angle (90°) restriction typical in conventional configurations. In other words, the ports in the manifold run substantially straight through the manifold in the axial direction along the longitudinal axis without any cornering or similar restriction. By eliminating the high angle (90°) restriction, the present invention reduces flow losses and thus is more efficient and experiences less wear as compared to conventional configurations.

An aspect of the invention, therefore, is a commutator/manifold assembly configured to control a flow of hydraulic fluid to and from a hydraulic motor in a hydraulic fluid system. In exemplary embodiments, the commutator/manifold assembly includes a commutator having an offset design including a radially inner portion eccentrically encompassed within a radially outer portion, and commutator porting configured for a flow of hydraulic fluid through the commutator. A manifold includes a plurality of manifold ports, the manifold ports having a straight configuration by which walls defining the manifold ports run substantially along a longitudinal axis through an entirety of the manifold. In exemplary embodiments, a cross-sectional shape of the manifold ports is constant along a longitudinal axis through an entirety of the manifold, or alternatively the manifold ports may be flared or narrowing through the manifold, or alternatively the manifold ports may have different shapes on opposite sides of the manifold and are connected by draft angles or lofts in the flow paths. The commutator is configured to rotate to sequentially align the commutator porting with differing portions of the manifold ports to control a flow of hydraulic fluid through the commutator/manifold assembly. The commutator porting includes inner ports and outer ports that are isolated from each other by a commutator seal. A commutator ring has a guiding surface that guides rotation of the commutator. The rotation of the commutator provides a timed flow through the manifold ports straight through the manifold and without any directional flow restriction.

Another aspect of the invention is a hydraulic motor assembly. In exemplary embodiments, the hydraulic motor assembly includes the commutator/manifold assembly and a hydraulic motor, wherein the rotation of the commutator provides a timed flow of hydraulic fluid through the manifold ports to the motor and a return flow from the motor. The motor may have a gerotor configuration including an inner rotor set configured to rotate in a stator, the rotor set and the stator defining a plurality of motor pockets. Rotation of the commutator results in a timed alignment of the commutator porting with the manifold ports so as to provide a timed flow of hydraulic fluid to the motor pockets to maintain the rotation of the rotor set. Because the manifold ports have a straight configuration, such timed flow is provided without any directional restriction as is typical of conventional configurations. The hydraulic motor assembly may include a drive link operable to control a rotational positioning of the commutator.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto. Features that are described and/or illustrated with respect to one embodiment may be used in the same way or in a similar way in one or more other embodiments and/or in combination with or instead of the features of the other embodiments.

DETAILED DESCRIPTION

Figure 1:
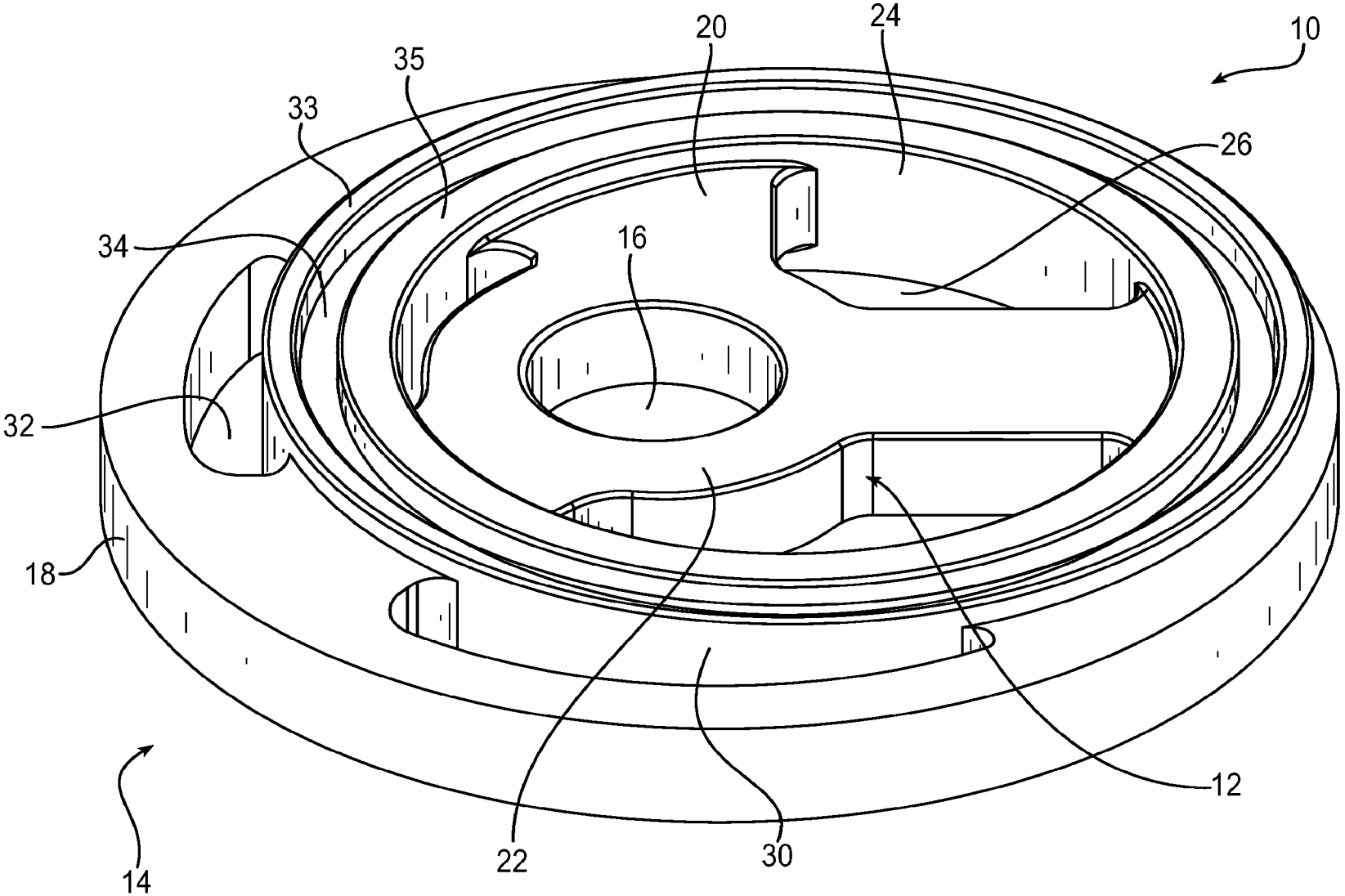
FIG. 1 is a drawing depicting an isometric view of an exemplary commutator in accordance with embodiments of the present invention.

Embodiments of the present invention will now be described with reference to the drawings, wherein like reference numerals are used to refer to like elements throughout. It will be understood that the figures are not necessarily to scale.

Figure 2:
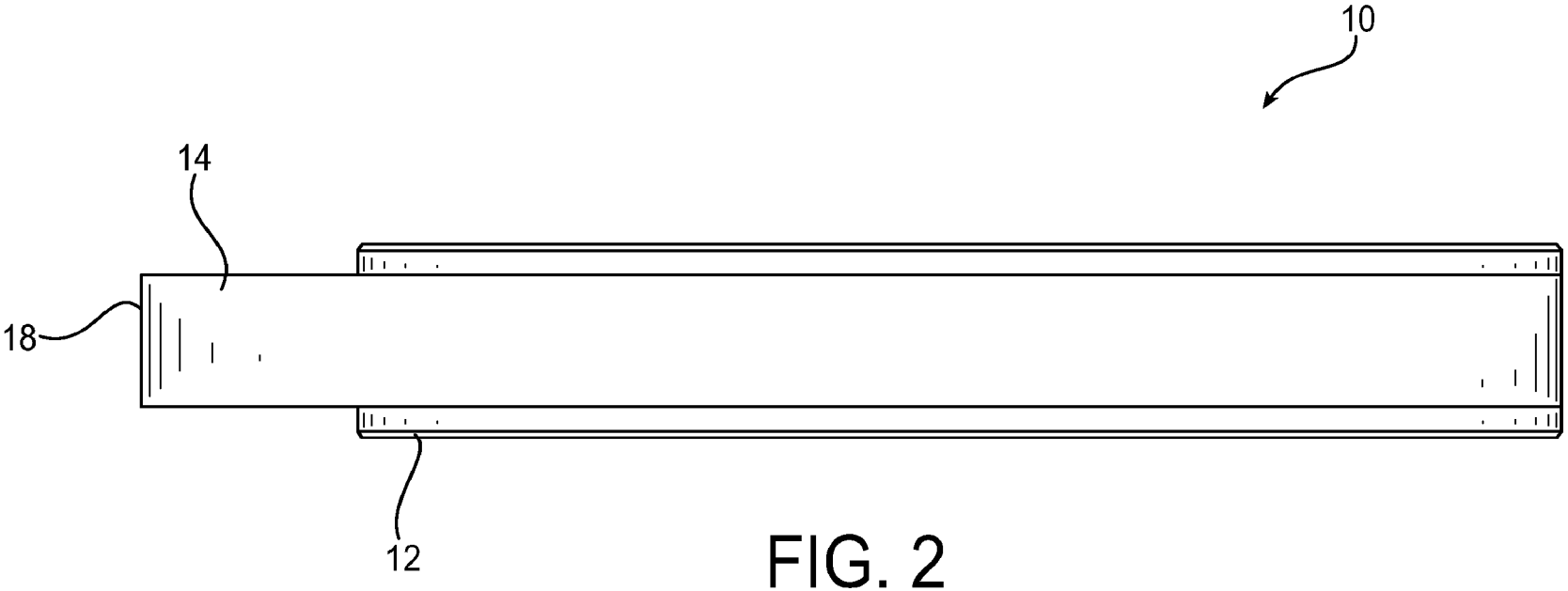
FIG. 2 is a drawing depicting a side view of the exemplary commutator of FIG. 1.

FIG. 1 is a drawing depicting an isometric view of an exemplary commutator 10 in accordance with embodiments of the present invention. FIG. 2 is a drawing depicting a side view the exemplary commutator 10 of FIG. 1. The commutator 10 is configured with an offset set design including a radially inner portion 12 eccentrically encompassed within a radially outer portion 14. The commutator 10 defines a central bore 16 that is centrally positioned relative to an outer diameter 18 of the commutator 10, but the central bore 16 is eccentrically offset within the inner portion 12 of the commutator 10. In the side view of FIG. 2, it can be seen that the inner portion 12 may have a greater thickness in the axial direction as compared to the outer portion 14. In addition, the offset design is illustrated also in FIG. 2, insofar as the inner portion 12 is eccentrically off center relative to the outer portion 14.

The commutator defines commutator porting configured to control a flow of hydraulic fluid through the commutator, the commutator porting being offset relative to a rotational or center axis of the commutator. Referring principally to FIG. 1, the inner portion 12 of the commutator 10 includes a plurality of supports that define a plurality of inner ports of the commutator porting. The plurality of supports may include a plurality of radial supports 20 that extend from an inner ring support 22 that defines the bore 16, to a radial face 24 of such inner portion 12. The bore 16 is configured to receive a drink link (not shown), which as further detailed below controls the radial positioning of the commutator. The supports 20, inner ring support 22, and first radial face 24 define a plurality of inner ports 26 that permit a flow of hydraulic fluid through the commutator at a first pressure. The inner ports are 26 are positioned eccentrically off center relative to a rotational or center axis of the commutator. In exemplary embodiments, the inner ports 26 may be low pressure side ports, i.e., the first pressure is a low case pressure that permits a return flow through the commutator that has originated downstream from the motor rotor set. The pressure, however, may be reversed such that the first pressure is a high pressure case to provide a source flow to the motor rotor set, in which case the direction of rotation of the rotor set is reversed. In the example shown in FIG. 1, there are three radial supports 20 that define three inner ports 26. It will be appreciated that the precise number and shape of the supports 20 and the resultant inner ports 26 may be varied as would be suitable for any particular application.

The outer portion 14 of the commutator 10 is generally a ring structure having the referenced outer diameter 18 and a second radial face 30. The second radial face 30 circumscribes the inner portion 12, and thus is commensurately positioned eccentrically off center relative to the outer diameter 18. The outer portion 14 defines at least one outer port of the commutator porting. In the example shown in the figures, the outer port is configured as a plurality of outer ports 32 that are defined in part by the radial face 30 and spaced inward from the outer diameter 18. The outer ports 32 permit a flow of hydraulic fluid through the commutator at a second pressure. In exemplary embodiments, the outer ports 32 may be high pressure side ports, i.e., the second pressure is a high case pressure that permits a forward or source flow through the commutator that has originated upstream from a hydraulic fluid source. As indicated above, however, the pressures may be reversed such that the second pressure is a low pressure case to provide a return flow from the motor rotor set, in which case the direction of rotation of the rotor set is reversed.

In the example shown in FIG. 1, the outer port is configured as two outer ports 32 each shaped as elongated slots defined by the outer portion 14. It will be appreciated that the precise number and shape of the outer ports 32 may be varied as would be suitable for any particular application, so long as an appropriate flow is provided that can be accommodated by the components, and particularly sealing components, at operational pressures and flow with minimal wear. For example, other configurations of the outer ports 32 may be a single elongated slot or multiple drill holes.

The commutator 10 further defines a groove 34 that separates and is between the inner portion 12 and the outer portion 14. The groove 34 may be formed between two rings or ridges 33 and 35. The groove is configured to receive a commutator seal (not shown in FIG. 1, but see FIGS. 5-8) that seals and isolates the inner portion 12 relative to the outer portion 14. In this manner, the commutator seal operates to isolate the inner ports on the first pressure (e.g., low pressure) side of the commutator from the at least one outer port on the second pressure (e.g., high pressure) side of the commutator.

Figure 3:
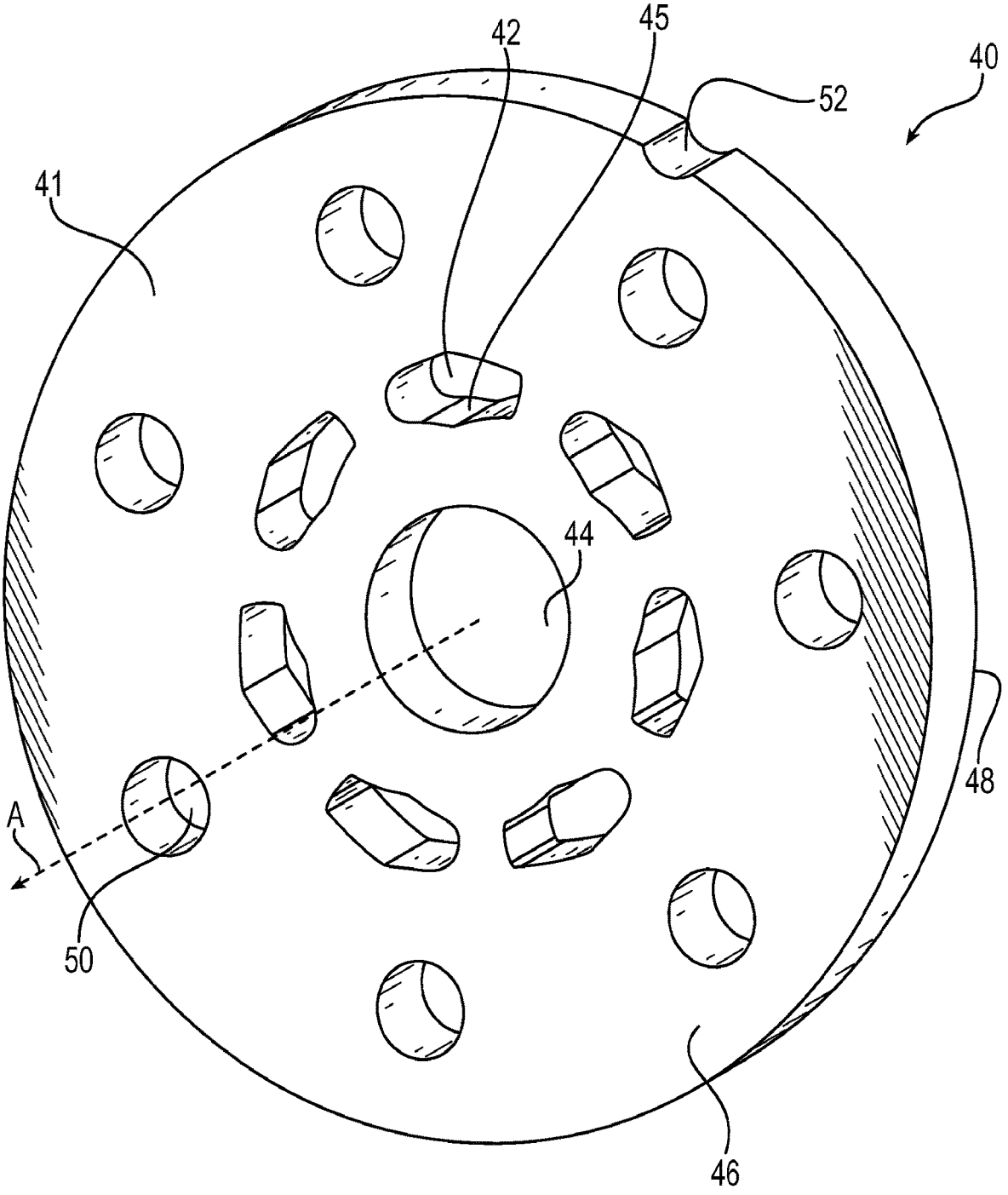
FIG. 3 is a drawing depicting an isometric view of an exemplary manifold in accordance with embodiments of the present invention.
Figure 4:
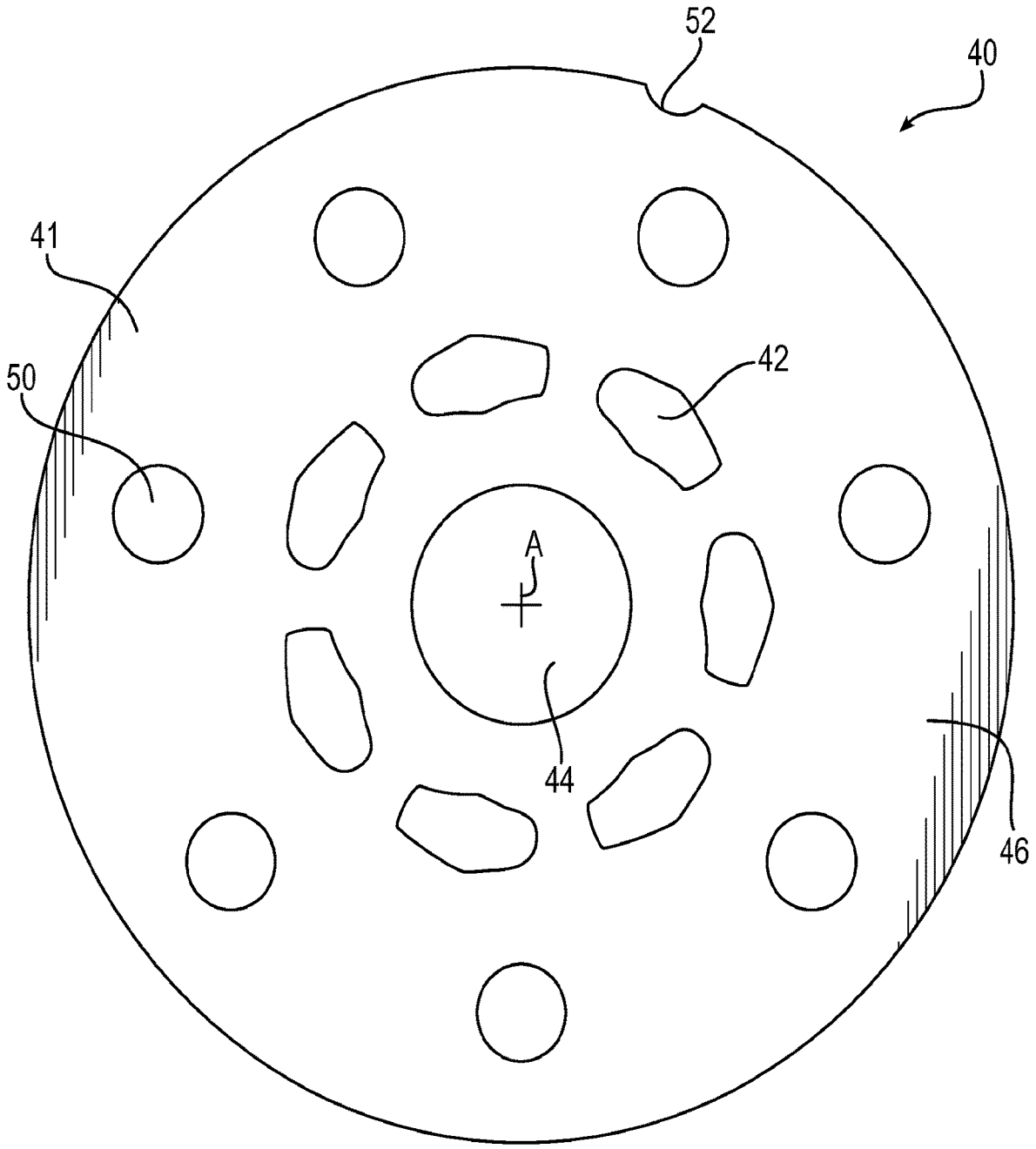
FIG. 4 is a drawing depicting a front facial view the exemplary manifold of FIG. 3.

The commutator 10 controls the flow of hydraulic fluid to and from the motor rotor set via a cooperating manifold component. FIG. 3 is a drawing depicting an isometric view of an exemplary manifold 40 in accordance with embodiments of the present invention. FIG. 4 is a drawing depicting a front or facial view the exemplary manifold 40 of FIG. 3.

The manifold 40 may be configured as a port plate including a plate 41 that defines a plurality of manifold ports 42. The plate 41 also defines a central manifold bore 44 through which the drive link (not shown) may extend and rotate. In particular, the central manifold bore 44 may be aligned with the central bore 16 of the commutator to receive the drive link.

FIG. 3 defines an axial direction "A" that constitutes the direction along a longitudinal axis of the manifold 40 (which in FIG. 4 is a direction perpendicular "out of page"). In embodiments of the present invention, in the axial direction the manifold ports 42 extend substantially straight through the manifold along such longitudinal axis. By referring to the manifold ports 42 having a "straight configuration" or running "substantially straight" or "substantially along the longitudinal axis", this means that walls 45 that define the ports 42, along the entirety of the ports 42, run substantially straight from a first commutator-side face 46 of the manifold to an opposite second motor-side face 48 of the manifold. In other words, in a straight configuration the flow paths are substantially straight, having no large bends or sharp angles in the flow paths through the manifold which are present in conventional configurations.

In an exemplary embodiment shown in FIG. 3, in one exemplary straight configuration the manifold ports run perpendicularly from the first commutator-side face 46 of the manifold to an opposite second motor-side face 48 of the manifold. Another way to describe this embodiment of a straight configuration of the flow path of a given port 42 is that a cross-sectional shape of the port 42 is constant all the way through the entirety of the manifold along the longitudinal axis in the axial direction A. Thus, in the front or facial view of FIG. 4, the ports appear as through-holes that extend all the way and straight through the manifold 40, with the walls 45 not being visible. As a result, fluid flow through the manifold 40 is wholly in the axial direction.

Figure 17:
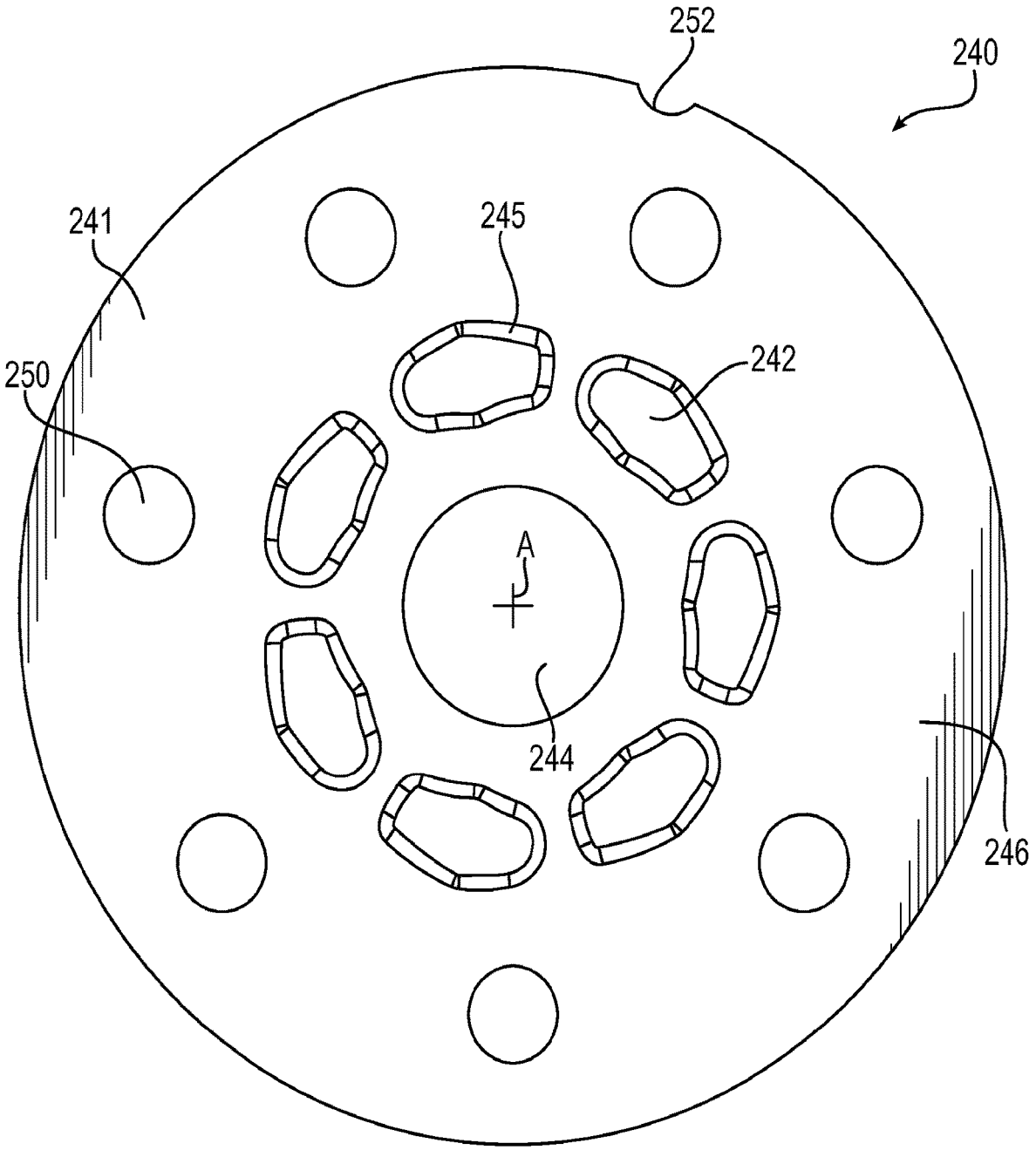
FIG. 17 is a drawing depicting a front view of another exemplary manifold in accordance with embodiments of the present invention.
Figure 18:
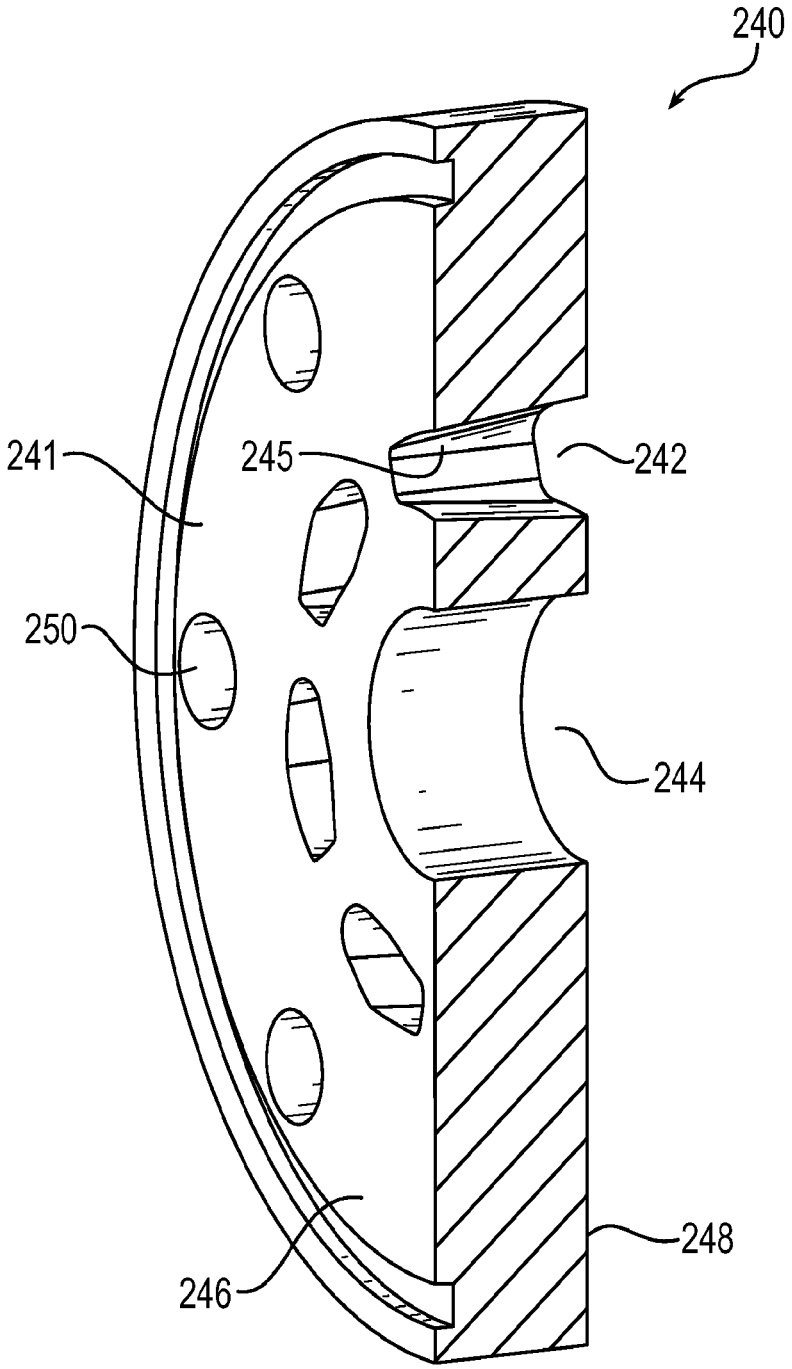
FIG. 18 is a drawing depicting a cross-sectional and perspective view of the exemplary manifold of FIG. 17.

An alternative embodiment of a straight configuration of flow paths through the manifold is shown in FIGS. 17 and 18. FIG. 17 is a drawing depicting a front view of an exemplary manifold 240 in accordance with embodiments of the present invention. FIG. 18 is a drawing depicting a cross-sectional and perspective view of the exemplary manifold 240 of FIG. 17. Similar to the previous embodiment, the manifold 240 may be configured as a port plate including a plate 241 that defines a plurality of manifold ports 242. The plate 241 also defines a central manifold bore 244 through which the drive link (not shown) may extend and rotate. In particular, the central manifold bore 244 may be aligned with the central bore 16 of the commutator to receive the drive link.

In the alternative embodiment of FIGS. 17 and 18, the straight configuration of the flow paths may be achieved by configuring the walls 245 that define the ports 242 running substantially straight but at a non-right angle along the entirety of the ports 242 from a first commutator-side face 246 of the manifold to an opposite second motor-side face 248 of the manifold. In this configuration, the flow paths remain substantially straight, having no large bends or sharp angles as in the previous embodiment. In the embodiment of FIGS. 17 and 18, however, the result is that ports on different sides of the manifold are not the same size. If the angle of the walls relative to the manifold faces is constant, the porting on opposite sides of the manifold will have the same shape but are of different size, in that the flow paths are flared from one side of the manifold to the other side. The reverse configuration also may be employed, wherein the flow paths narrow from one side of the manifold to the other. The flow remains substantially along the axial direction through the manifold 240, as again there are no large bends or sharp angles. In another variation, a shape of the manifold ports on the commutator side may differ from a shape on the motor/rotor set side to create a more optimized porting for each function (commutator vs rotor set). For different shaped ports, the flow passages through the manifold may contain draft angles or lofts to match and connect the different shapes. The basic flow paths would still be substantially straight along the longitudinal axis but could the ports may be larger or smaller, or different in shape, from one side of the manifold to another.

As referenced above, the manifold ports run through the manifold substantially in the axial direction (along the longitudinal axis), but the cross-sectional shape may be any suitable shape so as to provide for effective flow timing. In the example of FIGS. 3 and 4, there are seven manifold ports 42, and each may have an elongated cross-sectional shape that has a width in the radial direction that is smaller than a length in the circumferential direction around the longitudinal axis A. An elongated shape has been proven suitable to maintain properly timed fluid communication with the commutator porting 26 and 32, and further with porting in fluid communication with the motor rotor set. In exemplary embodiments, the manifold ports may be shaped as kidney ports. As with the commutator ports, it will be appreciated that the precise number and shape of the manifold ports 42 may be varied in cross-sectional shape as would be suitable for any particular application, provided such cross-sectional shape is associated with manifold ports having a straight configuration in which the manifold ports run through the entirety of the manifold substantially along the longitudinal axis A.

The straight configuration of the manifold ports 42 differs from conventional configurations as described in the background section of the current application. In conventional configurations, to provide an appropriate timing for the fluid flow to and from the motor rotor set and the commutator, the manifold ports do not provide straight-through flow paths. Rather, conventional manifold ports are configured to provide flow paths with a high angle (e.g., 90°) directional change within the manifold itself. This creates a substantial flow restriction and resultant high flow losses, which are avoided in the present invention.

The restricted flow of conventional configurations is eliminated in the present invention by combining the offset design of the commutator 10 with the straight configuration of the flow ports through the manifold 40. In particular, the commutator 10 is configured with the offset design described above by which the inner portion 12 (including the inner ports 26) is eccentrically configured off center relative to the outer diameter 18 defining the outer portion 14 (including the outer ports 32). As a result, rotation of the commutator 10 results in precise timing of flow of hydraulic fluid to and from the motor rotor set based on which of the inner and outer commutator ports become aligned with corresponding ones of the straight ports 42 in the cooperating manifold 40. Because the flow timing results from the rotational position of the offset design commutator 10, the manifold 40 may be configured simply as a port plate with such substantially straight ports 42 or 242 extending axially through the entire manifold. The manifold 40, therefore, may be substantially thinner as compared to conventional timing manifolds, resulting in overall cost and space savings of the motor components. In addition, the offset commutator design with the straight configuration manifold ports provides flow timing in a manner that eliminates the need for the high angle or 90° flow path restrictions as required through conventional manifolds. Accordingly, the present invention substantially reduces flow losses as compared to conventional configurations.

Referring again to FIGS. 3 and 4, the plate 41 of the manifold 40 further may define a plurality of fastening holes 50 that may receive any suitable fastening elements. The fastening elements may be bolts, screws, or any other suitable fastening elements for securing the manifold to other motor components. The manifold 40 further may include a locating recess 52 in the outer diameter of the manifold 40. The locating recess 52 may used to properly position and align the manifold 40 with respect to the other motor components during assembly.

The commutator 10 and the manifold 40, therefore, may be incorporated in combination into a commutator/manifold assembly configured to control a flow of hydraulic fluid to and from a hydraulic motor in a hydraulic fluid system. In exemplary embodiments, the commutator/manifold assembly includes a commutator having an offset design including a radially inner portion eccentrically encompassed within a radially outer portion, and commutator porting configured for a flow of hydraulic fluid through the commutator. A manifold includes a plurality of manifold ports, the manifold ports having a straight configuration by which walls defining the manifold ports run substantially along a longitudinal axis through an entirety of the manifold. The commutator is configured to rotate to sequentially align the commutator porting with differing portions of the manifold ports to control a flow of hydraulic fluid through the commutator/manifold assembly. The rotation of the commutator provides a timed flow through the manifold ports substantially straight through the manifold and without any directional flow restriction.

Figure 5:
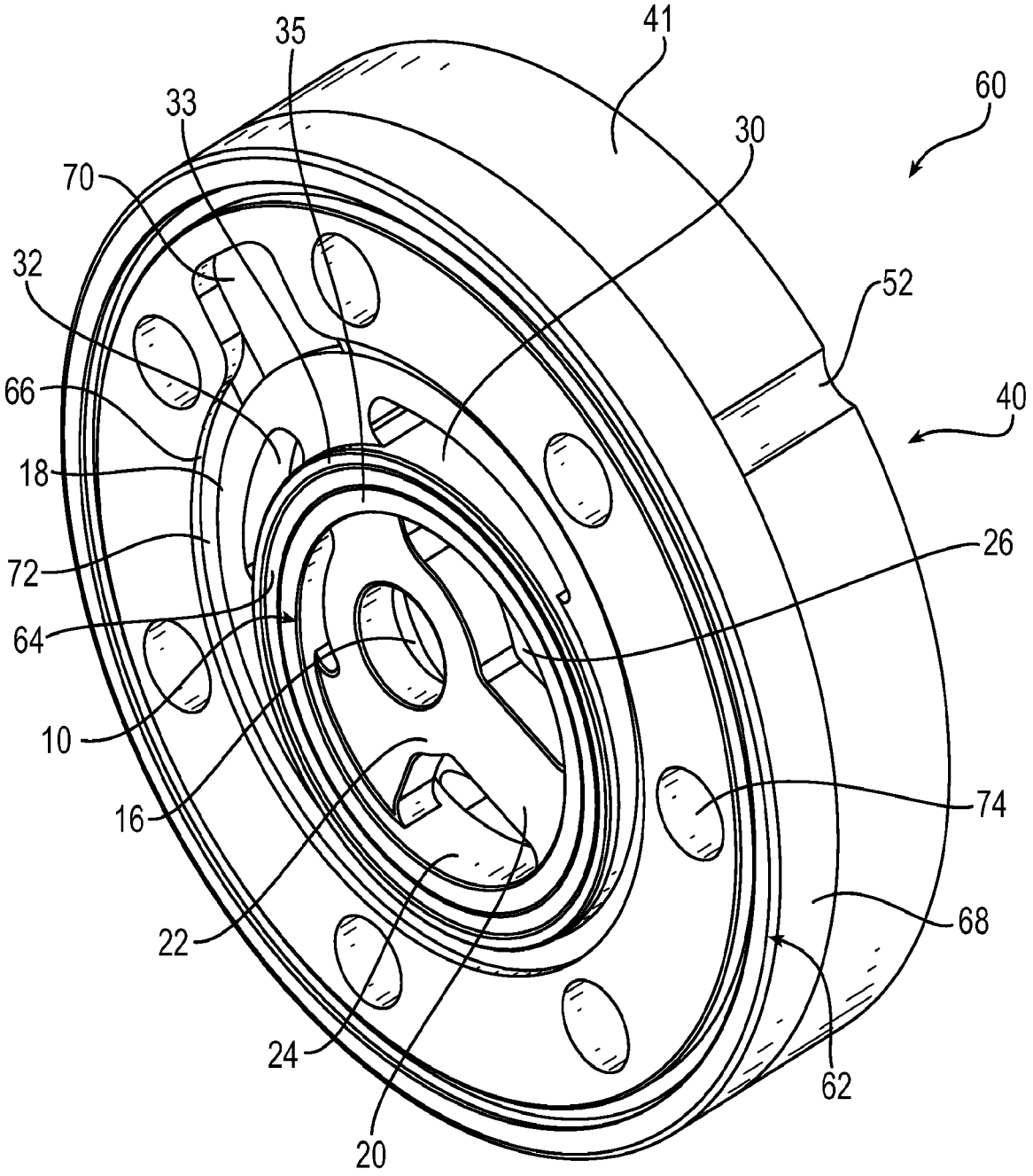
FIG. 5 is a drawing depicting an isometric view from the viewpoint on the commutator side of an exemplary commutator/manifold assembly in accordance with embodiments of the present invention.
Figure 6:
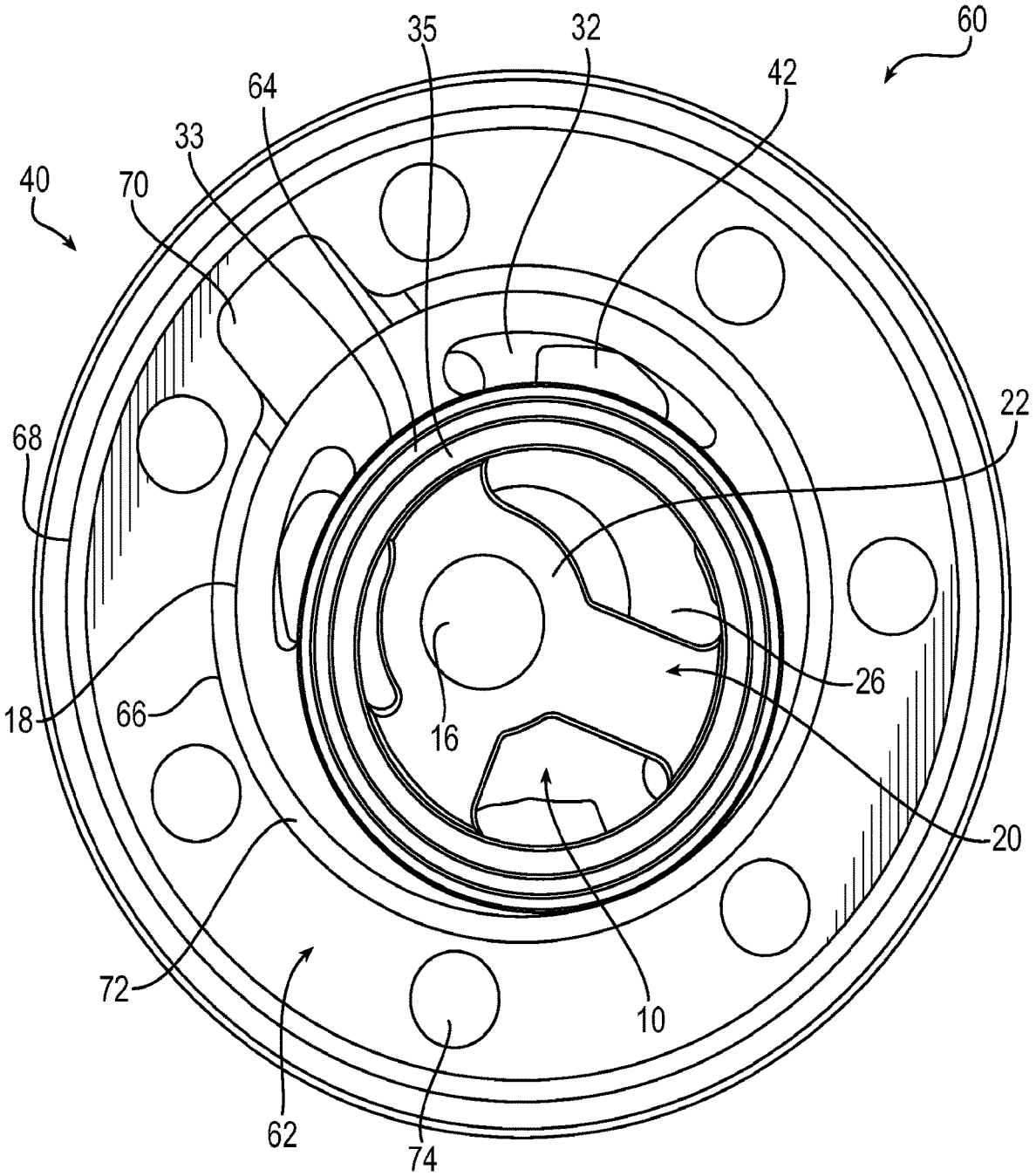
FIG. 6 is a drawing depicting a front facial view from the viewpoint on the commutator side of the exemplary commutator/manifold assembly of FIG. 5.
Figure 7:
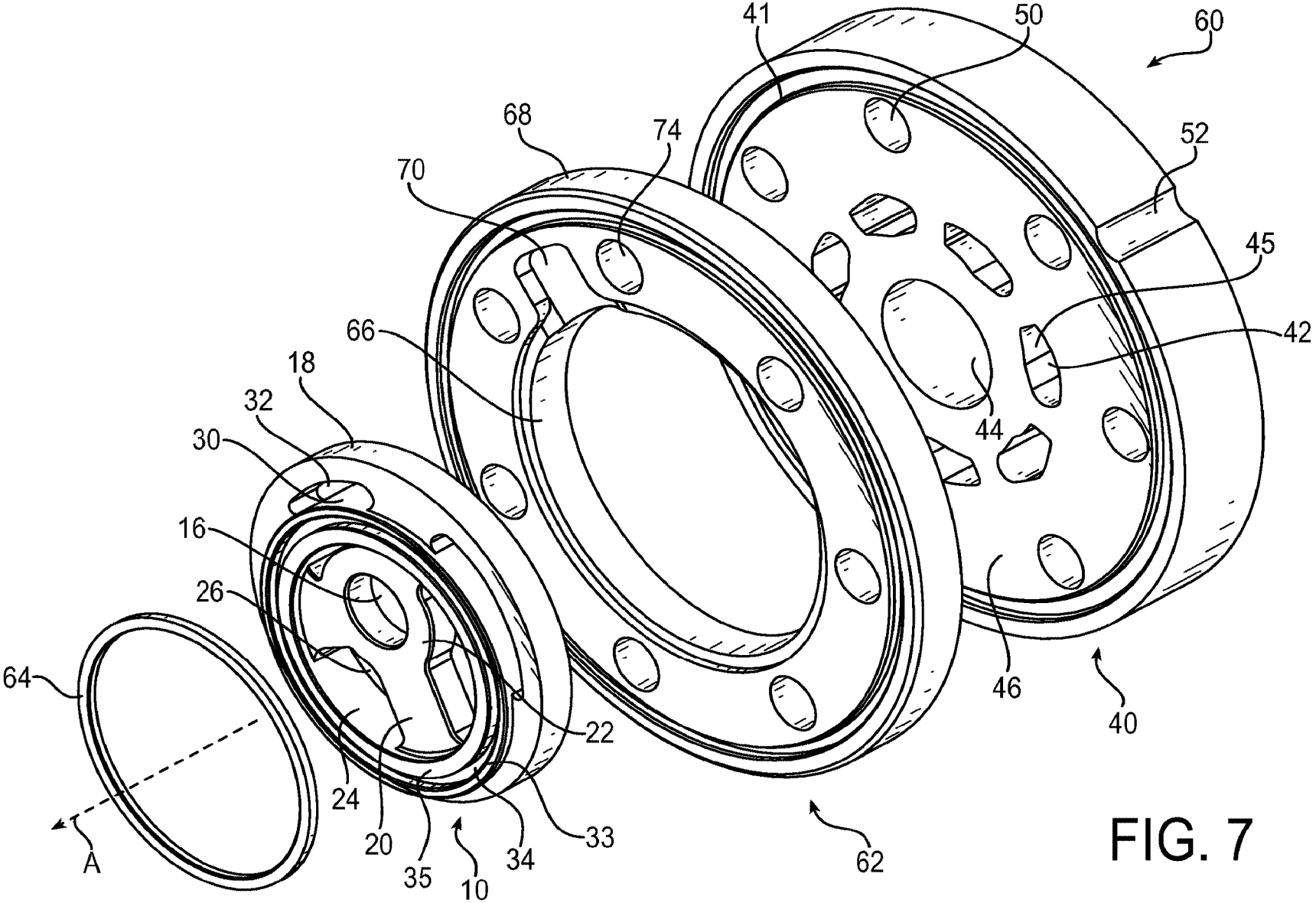
FIG. 7 is a drawing depicting an exploded isometric view from the viewpoint on the commutator side of the exemplary commutator/manifold assembly of FIG. 5.
Figure 8:
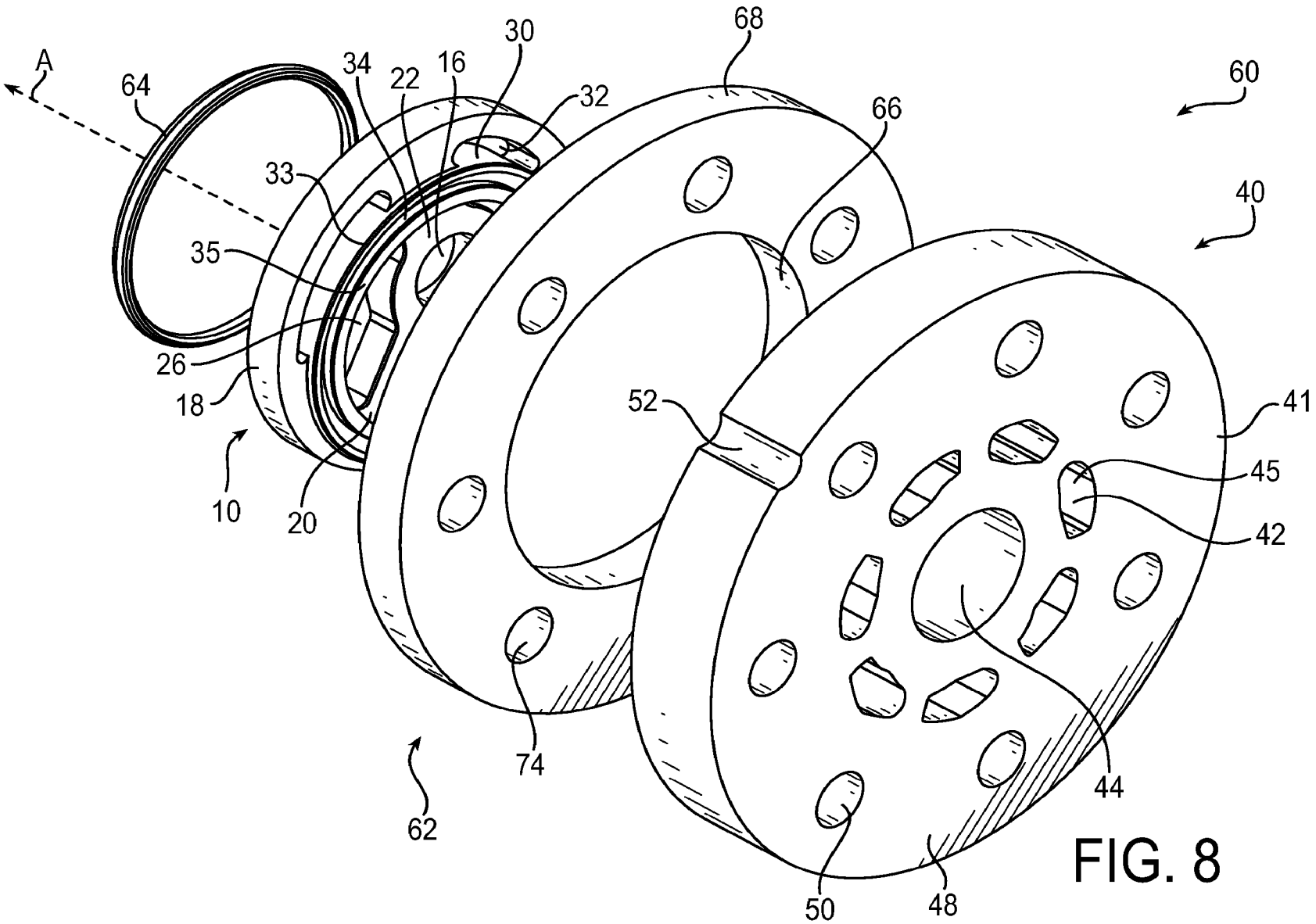
FIG. 8 is a drawing depicting an exploded isometric view from the viewpoint on the manifold side of the exemplary commutator/manifold assembly of FIG. 5.

FIGS. 5-8 depict various views of an exemplary commutator/manifold assembly 60 including the commutator 10 and the manifold 40. Accordingly, like components are identified with common reference numerals in FIGS. 5-8 as in FIGS. 1-4. It will also be appreciated that the manifold 240 of FIGS. 17 and 18 may be used instead of the manifold 40. FIG. 5 is a drawing depicting an isometric view from the viewpoint on the commutator side of an exemplary commutator/manifold assembly 60 in accordance with embodiments of the present invention. FIG. 6 is a drawing depicting a front view from the viewpoint on the commutator side of the commutator/manifold assembly 60 of FIG. 5. FIG. 7 is a drawing depicting an exploded isometric view from the viewpoint on the commutator side of the exemplary commutator/manifold assembly 60 of FIG. 5. FIG. 8 is a drawing depicting an exploded isometric view from the viewpoint on the manifold side of the exemplary commutator/manifold assembly 60 of FIG. 5.

The commutator/manifold assembly 60 includes the commutator 10 and the manifold 40 described above. The commutator/manifold assembly 60 further includes a commutator ring 62 and a commutator seal 64. The commutator ring includes an inner diameter guiding surface 66 and an outer diameter 68. A bushing may be provided between the guiding surface 66 and outer diameter 18 of the commutator 10. A main flow port 70 is in fluid communication with the guiding surface 66, which ultimately is in fluid communication with the outer ports of the commutator porting as described in more detail below.

In operation, the guiding surface 66 of the commutator ring 60 is configured to act as a guiding surface for the rotation of the commutator 10. There further is a slight degree of orbital rotation of the commutator 10 within the commutator ring 62 along the guiding surface 66. In other words, the commutator 10 rotates within the commutator ring 62 such that the outer diameter 18 of the commutator 10 slides adjacent the guiding surface 66 of the commutator ring. Accordingly, there tends to be a slight gap 72 (see particularly FIGS. 5 and 6) between the commutator and the commutator ring as the commutator rotates. This forms what was designated above as the second pressure side. On the second pressure side of the assembly, hydraulic fluid from a fluid source flows through the main flow port 70 into the gap 72. Referring again additionally to FIG. 2 (the side view of the commutator 10), as referenced above the inner portion 12 of the commutator 10 may have a greater thickness in the axial direction as compared to the outer portion 14. As a result, when the commutator 10 is positioned for rotation relative to the commutator ring 62, the gap 72 between the commutator outer diameter and in guiding surface 66 extends over the outer portion 14 of the commutator. This forms a fluid pathway including in fluid communication the main flow port, the gap defined by the guiding surface of the commutator ring and the outer portion of the commutator, and the at least one outer port of the commutator porting. Referring to the figures, therefore, on the second pressure side fluid can flow from the main flow port 70, through the gap 72, and subsequently through the outer ports 32 of the commutator to the manifold 40 (or vice versa for reverse pressure/flow).

The exploded views of FIGS. 7 and 8 illustrate the commutator seal 64 isolated from the commutator 10, and FIGS. 5 and 6 illustrate the commutator seal 64 located in it use position within the commutator 10. As referenced above, the commutator 10 has rings or ridges 33 and 35 that define a groove 34 that is between and separates the inner portion 12 and the outer portion 14. The groove is configured to receive the commutator seal 64 to seal and isolate the inner portion 12 relative to the outer portion 14. In this manner, the commutator seal 64 operates to isolate the first pressure inner side of the commutator from the second pressure outer side of the commutator. Although such a seal isolates the two pressure sides in exemplary embodiments, other isolation configurations may be employed. For example, an exemplary embodiment eliminates the commutator seal and groove and relies on a specific side clearance to achieve sealing with the metal to metal interface floating on a film of oil. Again, in exemplary embodiments, the inner ports 26 may be low pressure ports, i.e., the first pressure inner side is a low case pressure that permits a return flow through the commutator that has originated downstream from the motor rotor set. The outer ports 32 may be high pressure ports, i.e., the second pressure outer side is a high case pressure, that permits a forward flow through the commutator to the manifold and then to the motor rotor set. The pressures, however, may be reversed such that the first pressure is the high pressure side and the second pressure is the low pressure side, in which case the direction of the motor is reversed.

The commutator ring further may define a plurality of additional fastening holes 74 that may receive any suitable fastening elements. For assembly, the fastening holes 74 may be aligned with the fastening holes 50 of the manifold 40 to mount the commutator ring and the manifold together, and to additional components of the motor. As described above, the fastening elements may be bolts, screws, or any other suitable fastening elements for securing the manifold and the commutator ring to each other and to other motor components.

Figure 9:
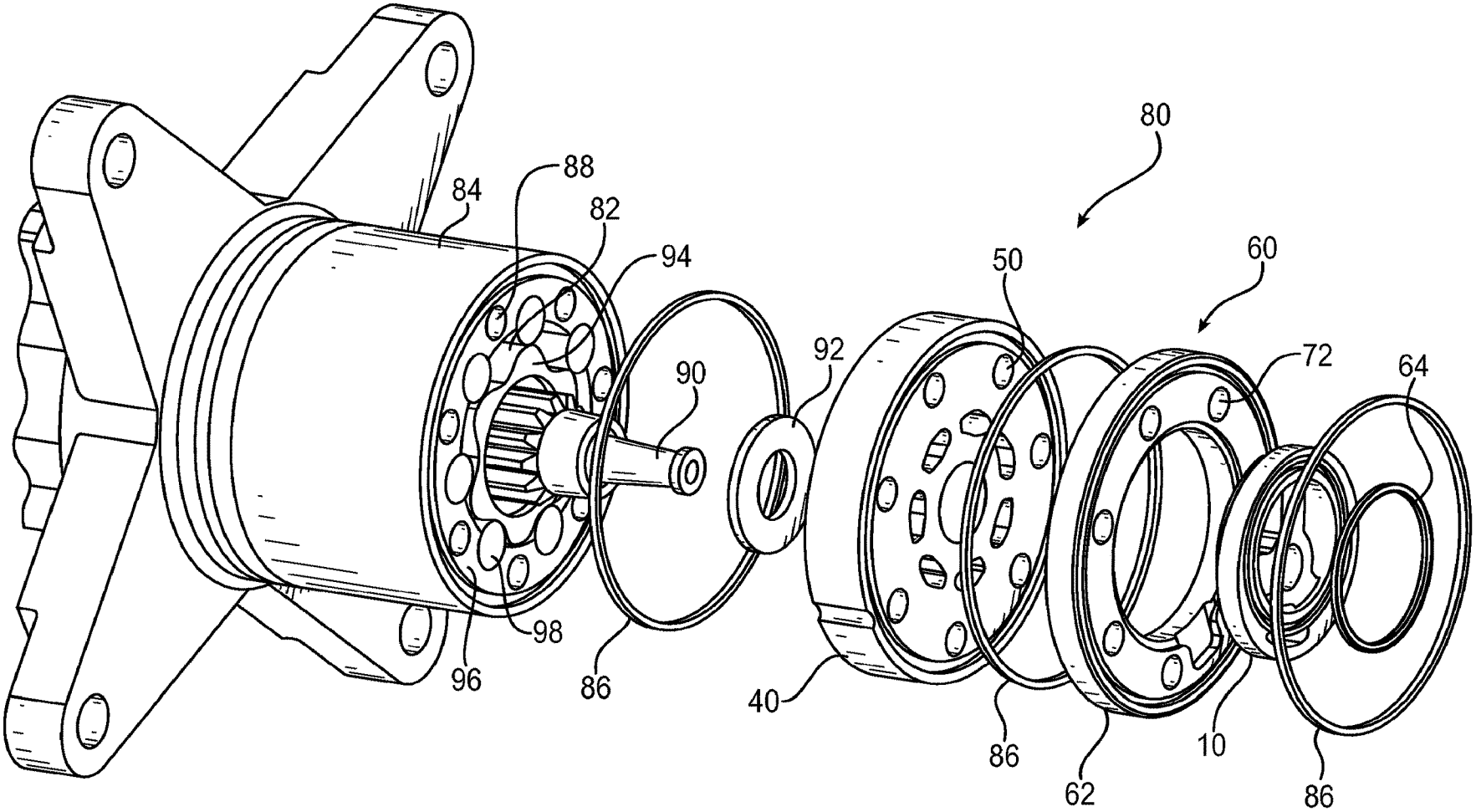
FIG. 9 is a drawing depicting an exploded and isometric view of an exemplary motor assembly in accordance with embodiments of the present invention.
Figure 10:
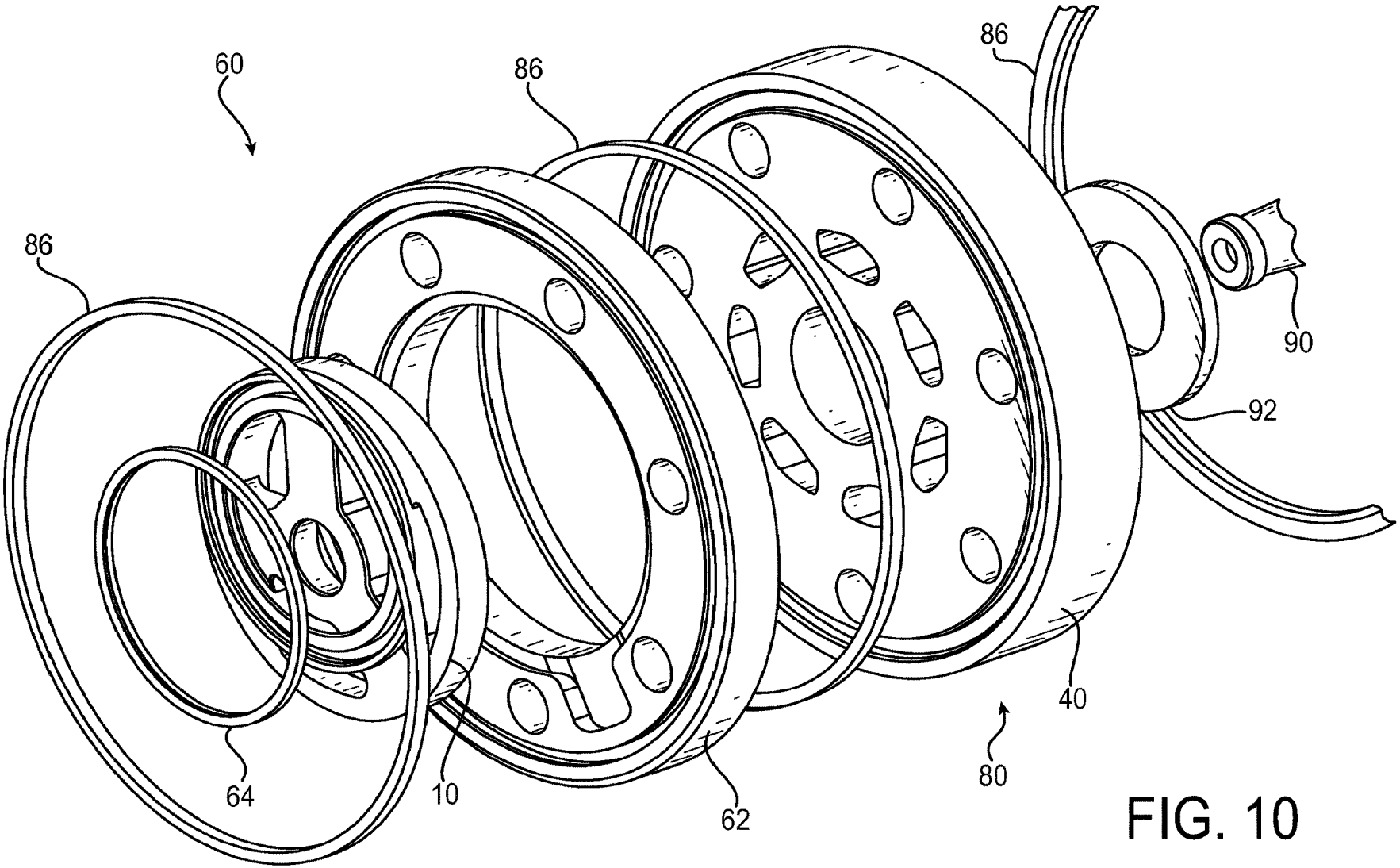
FIG. 10 is a drawing depicting another exploded and isometric view of the exemplary motor assembly of FIG. 9, with a closer view of the commutator/manifold assembly components.

FIG. 9 is a drawing depicting an exploded and isometric view of an exemplary motor assembly 80 in accordance with embodiments of the present invention. FIG. 10 is a drawing depicting another exploded and isometric view of the exemplary motor assembly 80 of FIG. 9, with a closer view of the commutator/manifold assembly 60 components. The components of the commutator/manifold assembly 60 are incorporated as part of the motor assembly 80, and like reference numerals again are used to refer to like components. It will also be appreciated that the manifold 240 of FIGS. 17 and 18 may be used instead of the manifold 40. The motor assembly may include a motor rotor set 82 which may be secured within a motor housing 84. The various components may be sealed utilizing a plurality of O-ring seals 86. The motor rotor set 82 may include a plurality of fastening holes 88 to be correspondingly aligned with the fastening holes 72 and 50 of the commutator ring and manifold. Accordingly, common fastening elements (e.g., bolt, screws) may be employed to secure the elements of the motor assembly together and to a main motor housing (not shown). The motor assembly 80 further includes a drive link 90 that is supported in position at least in part with a thrust washer 92. The drive link is operable to control the rotational position of the commutator, which controls the flow of hydraulic fluid through the manifold in the manner described above, and ultimately to and from the motor rotor set 82.

In exemplary embodiments, the motor rotor set 82 has a gerotor configuration including an inner rotor 94 that has lobes and rotates within a motor stator 96 against and relative to a plurality of roller vanes 98. The motor pockets are defined between the inner rotor 94 and the motor stator 96, and change volume as the inner rotor 94 rotates within the motor stator 96 relative to the roller vanes 98. This action permits the inflow and forces the outflow of the hydraulic fluid from the motor, which causes the inner rotor 94 to rotate. As referenced above, in an alternative configuration lobes may be provided on the stator and vanes may be provided on the rotor set.

The overall flow occurs as follows. In a typical example, the outer commutator ports 32 are on the high pressure side, and the inner commutator ports 26 are on the low pressure side, with the commutator seal 64 isolating the two pressure sides from each other as described above. The rotation of the commutator 10 and simultaneous orbiting of the commutator ports within the commutator ring 62 results in a timed alignment on the high pressure side of the outer commutator ports 32 with a portion of the manifold ports 42. Hydraulic fluid, therefore, flows in a straight configuration, without directional restriction, through the manifold ports 42 into a portion of the motor pockets formed within the motor rotor set. On the low pressure side, the rotation of the commutator 10 and simultaneous orbiting of the commutator ports within the commutator ring 62 results in a timed alignment of the inner commutator ports 26 with a different portion of the manifold ports 42. A return flow of hydraulic fluid, therefore, flows in a straight configuration, again without directional restriction, through the manifold ports 42 from a portion of low pressure motor pockets formed within the motor rotor set. The pressure differential results in rotation of the motor rotor set, with a timed expanding and contraction of the motor pockets. The rotation of the rotor set drives rotation of an output shaft, which in turn may drive any suitable output element that may be connected to the output shaft (e.g., wheel axle, gear box, rotating fan, or other suitable usage).

As referenced above, one way to reverse the motor direction is to reverse the high pressure side and low pressure side of the fluid flow through the commutator porting. Another option known in the art is to provide a reverse timing manifold, which essentially provides flow paths to the motor pockets configured oppositely relative to a standard timing manifold. This results in a reversed flow without having to reverse the high pressure and low pressure sides of the flow with respect to the commutator porting. Otherwise, a conventional reverse-timing manifold is comparable to a conventional standard timing manifold in requiring a high angle restriction in the flow path. In the present invention, since the manifold ports have a straight configuration, there are no differently configured standard timing and reverse timing manifolds. In the present invention, due to the offset configuration of the commutator, reverse timing can be achieved more simply by flipping the commutator within commutator ring.

The present invention, therefore, has additional advantages over conventional assemblies with respect to the manner of achieving reverse timing. The present invention can achieve standard and reverse timing with the same components, i.e., the manifold has only one configuration for both standard and reverse timing rather than a standard timing manifold and a differently configured reverse timing manifold. In addition, flipping the commutator as done with the present invention is a far simpler maintenance operation as compared to changing out the manifold. The present invention, therefore, is more versatile with fewer components and less effort as compared to conventional configurations.

Figure 11:
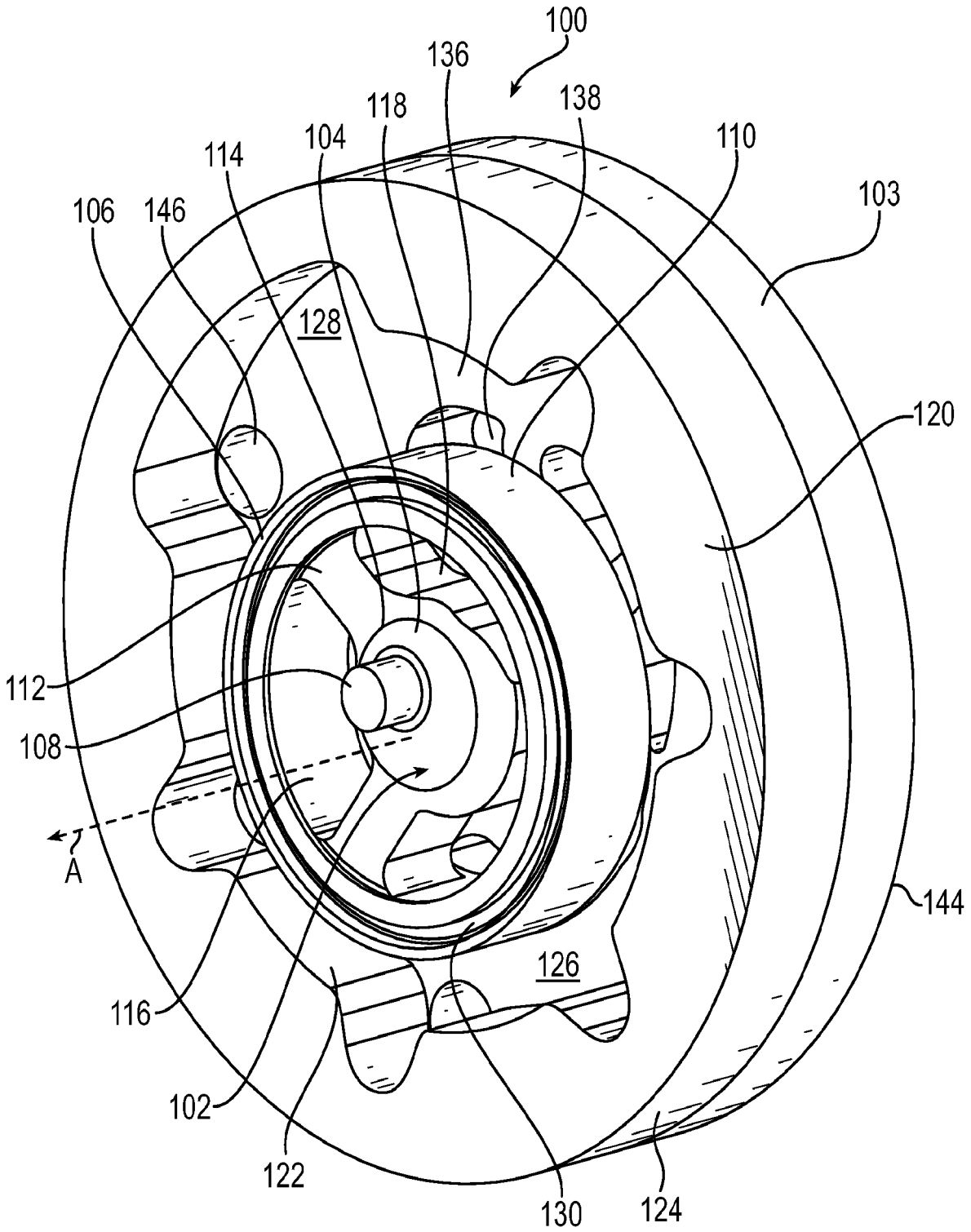
FIG. 11 is a drawing depicting an isometric view from the viewpoint on the commutator side of another exemplary commutator/manifold assembly in accordance with embodiments of the present invention.
Figure 12:
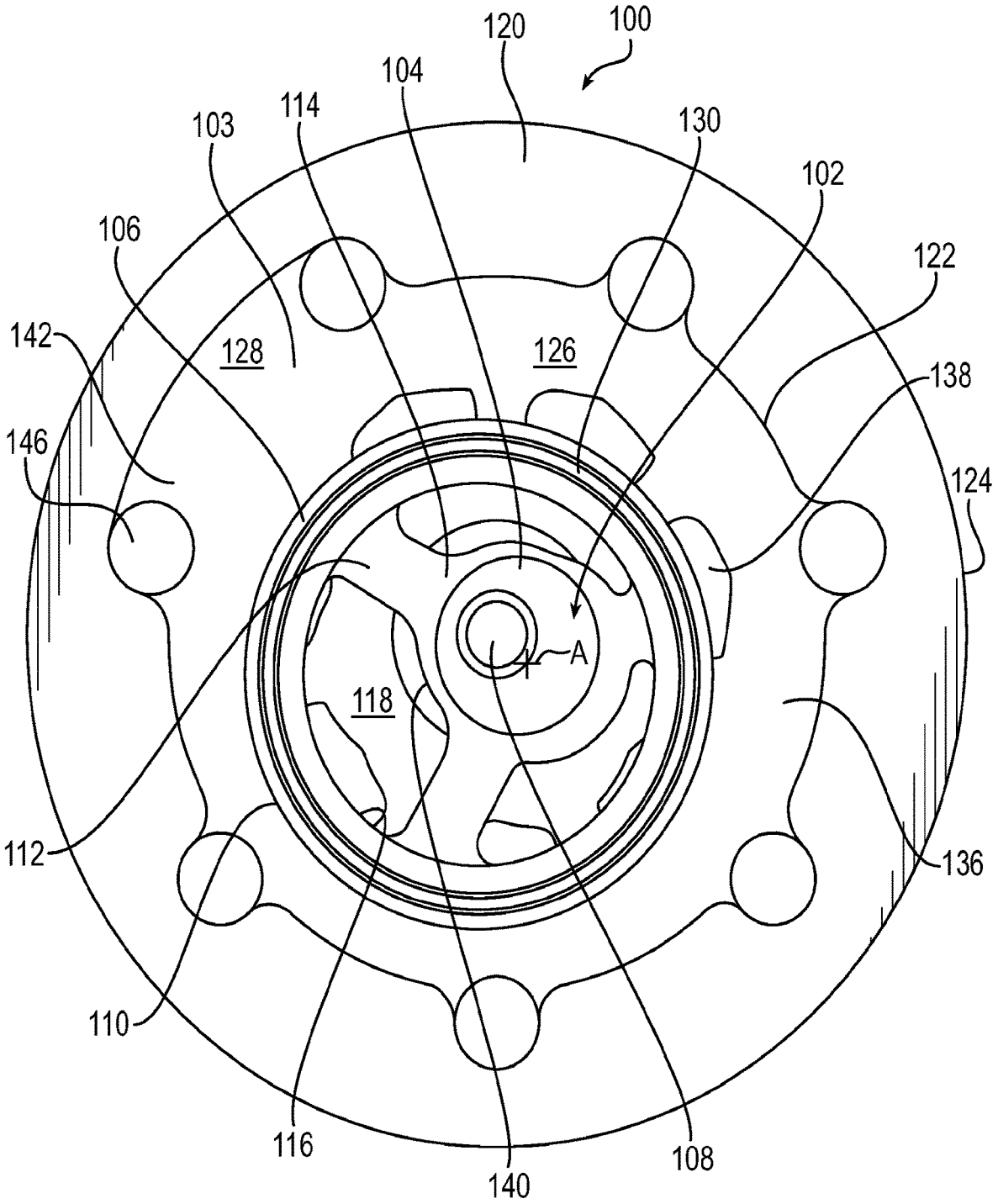
FIG. 12 is a drawing depicting a front facial view from the viewpoint on the commutator side of the exemplary commutator/manifold assembly of FIG. 11.

FIGS. 11-12 depict views of another embodiment corresponding to an exemplary commutator/manifold assembly 100 including a commutator 102 and a manifold 103. In particular, FIG. 11 is a drawing depicting an isometric view from the viewpoint on the commutator side of the exemplary commutator/manifold assembly 100 in accordance with embodiments of the present invention. FIG. 12 is a drawing depicting a front facial view from the viewpoint on the commutator side of the exemplary commutator/manifold assembly 100 of FIG. 11.

Similarly to the previous embodiment, in the example of FIGS. 11-12 the commutator 102 is configured with an offset design including a radially inner portion 104 eccentrically encompassed within a radially outer portion 106. In this particular example, the commutator 102 includes a central pin 108 that is positioned within the radially inner portion 104, but offset relative to a central position from an outer diameter 110 of the commutator 102. In other words, the offset design of the commutator 102 is achieved using the central pin 108 that is located offset relative to a longitudinal axis of the commutator 102, and the central pin 108 thus is eccentrically offset within the inner portion 104 relative to the commutator porting.

The commutator 102 also defines commutator porting configured to control a flow of hydraulic fluid through the commutator, the commutator porting being offset relative to a center longitudinal axis of the commutator. Referring to FIGS. 11 and 12, the inner portion 104 of the commutator 102 includes a plurality of supports that define a plurality of inner ports of the commutator porting. The plurality of supports may include a plurality of radial supports 112 that extend from an inner ring support 114 that supports the pin 108, to a radial face 116 of such inner portion 104. The radial supports 112, inner ring support 114, and radial face 116 define a plurality of inner ports 118 that permit a flow of hydraulic fluid through the commutator at a first pressure. The inner ports 118 are positioned eccentrically off center relative to a center longitudinal axis of the commutator, similarly as in the previous embodiment. In addition, in such offset design the central pin 108 likewise is offset eccentrically relative to the inner ports 118 of the commutator porting.

In exemplary embodiments, the inner ports 118 may be low pressure side ports, i.e., the first pressure is a low case pressure that permits a return flow through the commutator that has originated downstream from the motor rotor set. The pressure, however, may be reversed such that the first pressure is a high pressure case to provide a source flow to the motor rotor set, in which case the direction of rotation of the rotor set is reversed. In the example shown in FIGS. 11 and 12, there are three radial supports 112 that define three inner ports 118. As in the previous embodiment, it will be appreciated that the precise number and shape of the supports 112 and the resultant inner ports 118 may be varied as would be suitable for any particular application.

The outer porting is configured differently in the embodiment of FIGS. 11-12 as compared to the outer ports of the previous embodiment. In the embodiment of FIGS. 11-12, the commutator/manifold assembly 100 further includes a commutator ring 120 configured to guide the rotation of the commutator. The commutator ring may include an inner surface, and the inner surface of the commutator ring and the outer surface of the commutator define the at least one outer port.

Referring to the example in FIGS. 11-12, the commutator ring includes an inner diameter surface 122 and an outer diameter surface 124. Outer porting 126 is defined between the inner diameter surface 122 of the commutator ring 120 and the outer diameter surface 110 of the commutator 102. Similarly to the previous embodiment, the outer porting 126 permits a flow of hydraulic fluid through the assembly at a second pressure. In exemplary embodiments, the outer porting 126 may be high pressure side porting, i.e., the second pressure is a high case pressure that permits a forward or source flow through the assembly that has originated upstream from a hydraulic fluid source. As indicated above, however, the pressures may be reversed such that the second pressure is a low pressure case to provide a return flow from the motor rotor set, in which case the direction of rotation of the rotor set is reversed. A main flow port 128 is in fluid communication with the inner diameter surface 122, and thus is configured to be in fluid communication with the at least one outer port 126 defined by the commutator and commutator ring surfaces. In operation, on the second pressure side of the assembly, hydraulic fluid from a fluid source flows through the main flow port 128 into the outer porting 126 (or vice versa for reverse pressure/flow).

Similarly to the previous embodiment, the commutator 100 further defines a groove 130 that separates and is between the inner portion 104 and the outer portion 106. The groove 130 may be formed between two rings or ridges on the commutator similarly as in the previous embodiment. The groove again is configured to receive a commutator seal (not shown) that seals and isolates the inner portion 104 relative to the outer portion 106. In this manner, the commutator seal operates to isolate the inner ports on the first pressure (e.g., low pressure) side of the commutator from the outer porting on the second pressure (e.g., high pressure) side of the commutator.

As in the previous embodiment, the commutator 102 controls the flow of hydraulic fluid to and from the motor rotor set via the cooperating manifold 103. The manifold 103 generally is configured comparably as the manifold 40 in the previous embodiment. The manifold 103 also may be configured as a port plate including a plate 136 that defines a plurality of manifold ports 138. The plate 136 also defines a central manifold bore 140 (see particularly FIG. 11) through which the drive link (not shown) may extend and rotate. FIGS. 11 and 12 likewise as FIGS. 3 and 4 define an axial direction "A" that constitutes the direction along a center longitudinal axis of the commutator 102 (which in FIG. 12 is a direction perpendicular "out of page"). As referenced above, the central pin 108 is offset relative to such longitudinal axis of the commutator. It will also be appreciated that the manifold 240 of FIGS. 17 and 18 may be used instead of the manifold 40.

In this exemplary embodiment as in the previous embodiment, in the axial direction along the longitudinal axis, the manifold ports 138 extend substantially straight through the manifold along such longitudinal axis with a "straight configuration" as previously defined. Accordingly, the walls that define the ports 138, along the entirety of the ports 138, run substantially straight all the way through the entirety of the manifold substantially along the longitudinal axis in the axial direction A. In this embodiment also, therefore, the restricted flow of conventional configurations is eliminated by combining the offset design of the commutator 100 with the straight configuration of the flow ports through the manifold 103.

Referring more particularly to FIG. 12, the plate 136 of the manifold 103 further may define a plurality of fastening holes 146 that may receive any suitable fastening elements. The fastening elements may be bolts, screws, or any other suitable fastening elements for securing the manifold to other assembly components.

The commutator/manifold assembly 100 may be incorporated in place of the commutator/manifold assembly 60 in the motor assembly 80 depicted in FIG. 9. The appropriate motor elements, sealing, and bearing elements shown in FIG. 9 may therefore also be employed in combination with the commutator/manifold assembly 100.

Figure 13:
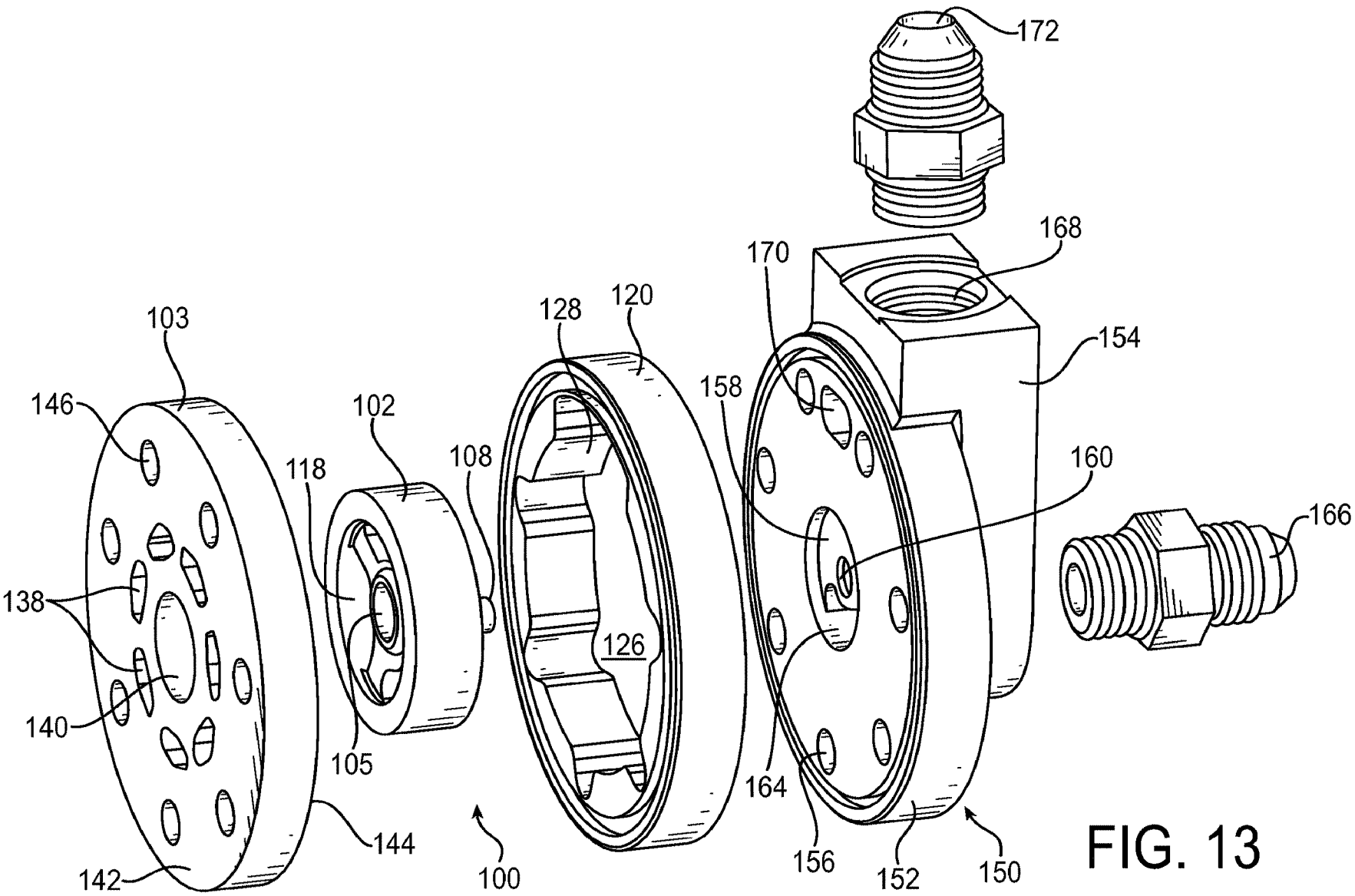
FIG. 13 is a drawing depicting an exploded isometric view from the viewpoint on the manifold side of the exemplary commutator/manifold assembly of FIGS. 11 and 12, with an additional end cover, in accordance with embodiments of the present invention.
Figure 14:
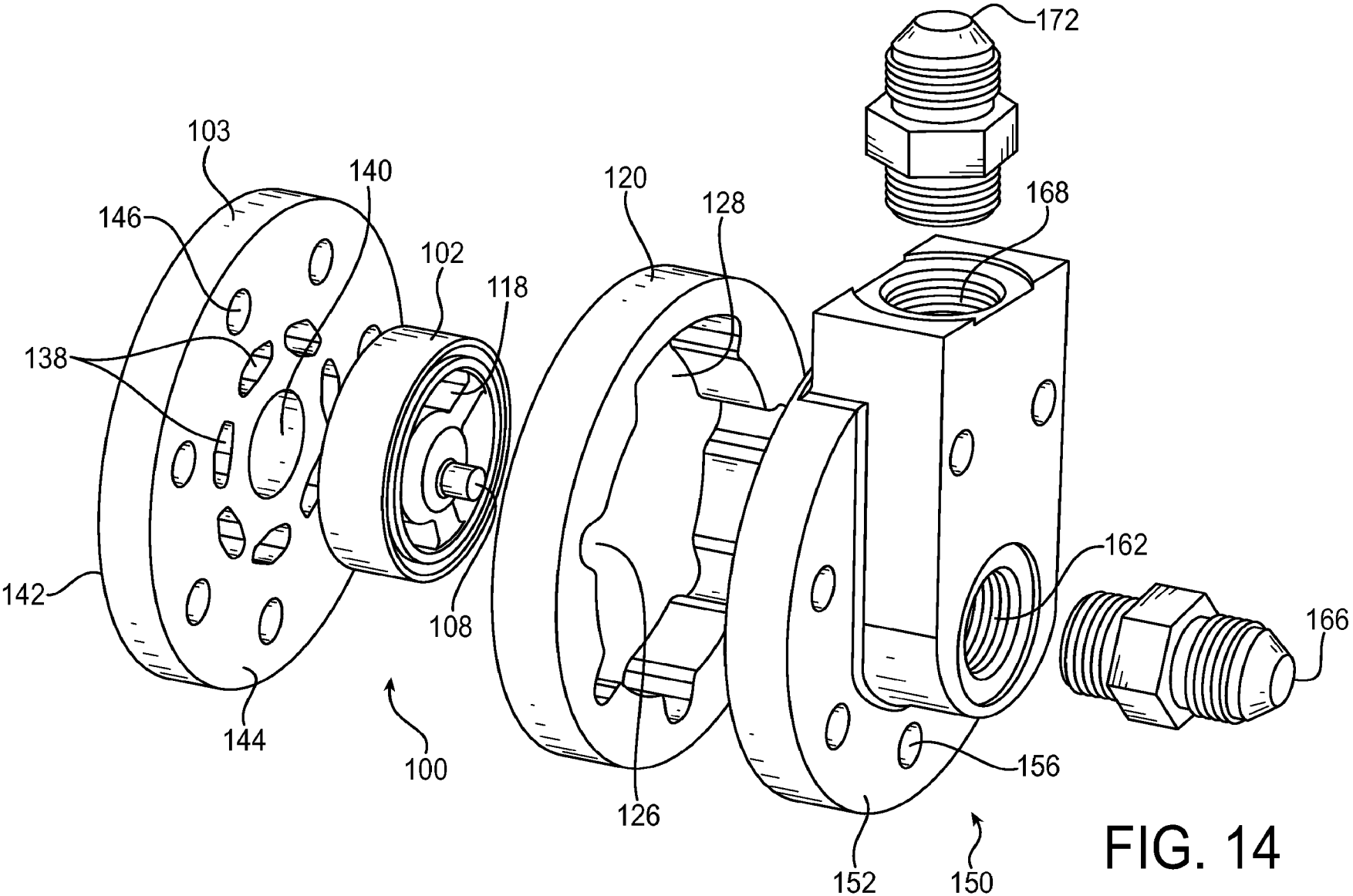
FIG. 14 is a drawing depicting an exploded isometric view from the viewpoint on the end cover side of the exemplary commutator/manifold assembly of FIG. 13.
Figure 15:
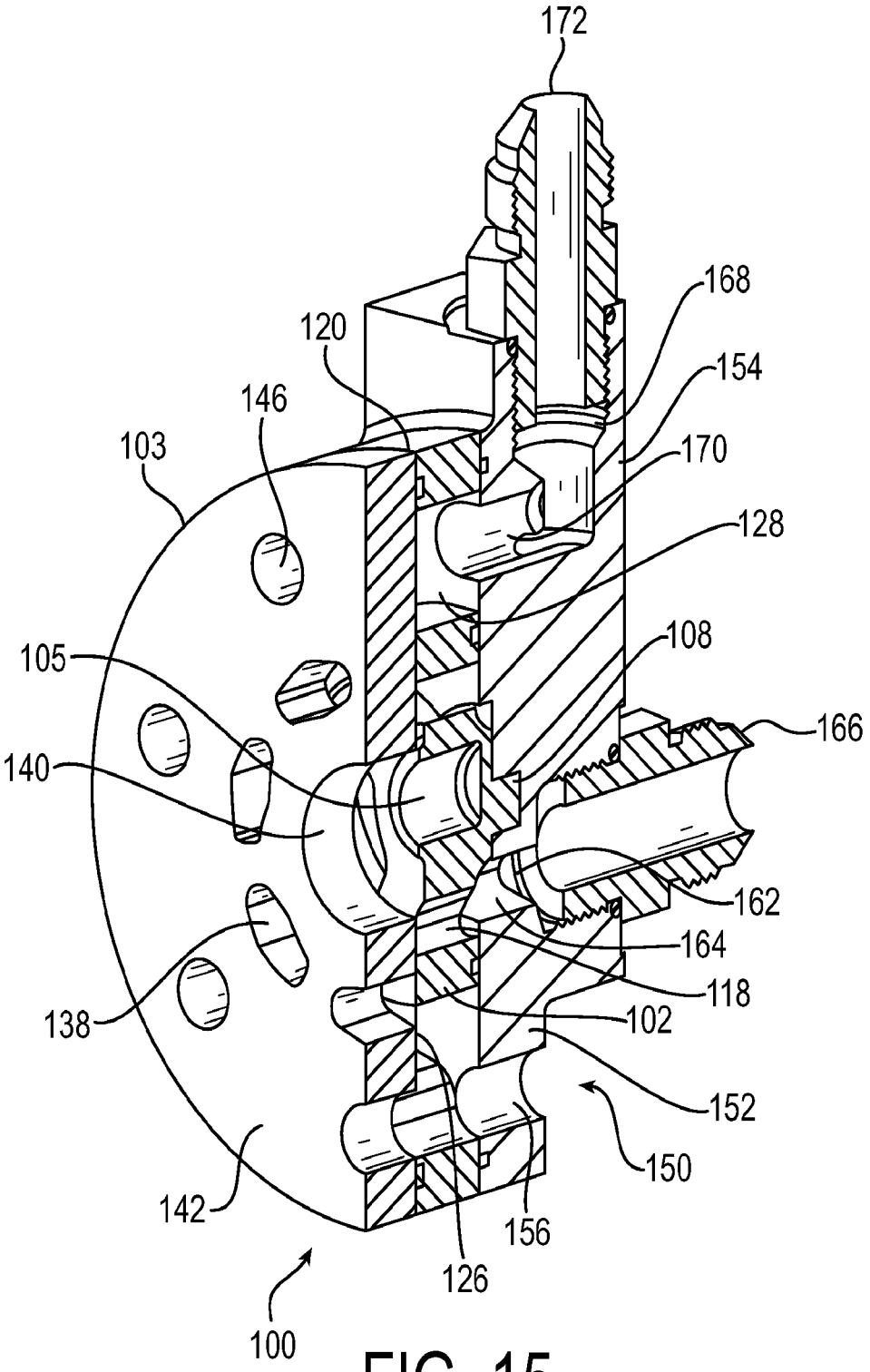
FIG. 15 is a drawing depicting an isometric and cross-sectional view from the viewpoint on the manifold side of the exemplary commutator/manifold assembly of FIGS. 13-14.
Figure 16:
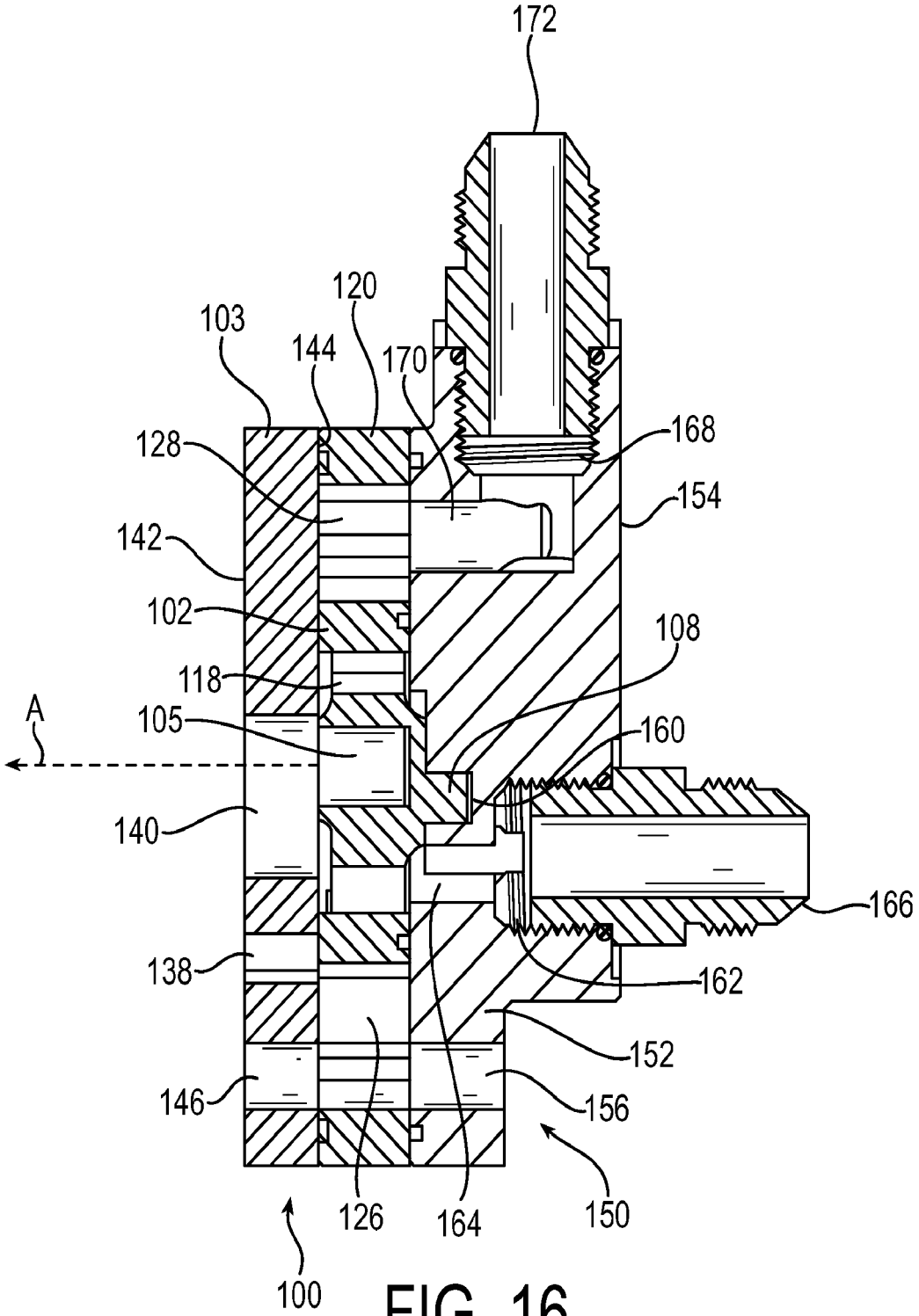
FIG. 16 is a drawing depicting a side cross-sectional view of the exemplary commutator/manifold assembly of FIGS. 13-15.

In the embodiment of FIGS. 11-12, the offset nature of the commutator is provided by the positioning of the central pin 108, and the manner by which rotation of the commutator is achieved with such central pin. To illustrate such operation, FIGS. 13-16 depict various views of the commutator/manifold assembly 100 with an additional end cover 150. Accordingly, like reference numerals are used to identify like components in FIGS. 13-16 as in FIGS. 11-12. In particular, FIG. 13 is a drawing depicting an exploded isometric view from the viewpoint on the manifold side of the exemplary commutator/manifold assembly 100 of FIGS. 11 and 12, with the additional end cover 150, in accordance with embodiments of the present invention. FIG. 14 is a drawing depicting an exploded isometric view from the viewpoint on the end cover side of the exemplary commutator/manifold 100 assembly of FIG. 13. FIG. 15 is a drawing depicting an isometric and cross-sectional view from the viewpoint on the manifold side of the exemplary commutator/manifold assembly 100 of FIGS. 13-14. FIG. 16 is a drawing depicting a side cross-sectional view of the exemplary commutator/manifold assembly 100 of FIGS. 13-15.

Generally, the end cover 150 is positioned on an opposite side of the commutator 102 relative to the manifold 103. It will also be appreciated that the manifold 240 of FIGS. 17 and 18 may be used instead of the manifold 103. As further detailed below, in exemplary embodiments in which the commutator includes the offset central pin 108, the end cover defines a pin hole for receiving the central pin of the commutator. When the commutator rotates, the central pin rotates within the pin hole such that the commutator porting rotates eccentrically relative to the longitudinal axis of the commutator. The end cover also may include fluid porting and passages for communicating a forward flow to and a return flow from the commutator.

As seen in the example of FIGS. 13-16, the commutator/manifold assembly 100 includes the commutator 102, the manifold 103, and the commutator ring 120 as described above. The end cover 150 may include a mounting portion 152 and a fluid communication portion 154. The mounting portion 152 may include mounting holes 156 that align with the fastening holes 146 of the manifold 103. In this manner, suitable fastening elements (e.g., bolts, screws, or the like) may be employed to mount the manifold 103, and thereby also the commutator 102 and commutator ring 120, to the end cover 150.

The end cover 150 may include a recess 158 that further defines a pin hole 160 (best seen in the exploded view of FIG. 13; see also pin hole 160 as identified in FIG. 16). The pin hole 160 is positioned and configured to receive the central pin 108 of the commutator 102. The cross-sectional views of FIGS. 15 and 16 in particular illustrate the manner by which the central pin 108 is located within the pin hole 160 when the commutator/manifold assembly is in an assembled state including the end cover. FIG. 16 also shows the longitudinal axis "A", which illustrates the offset nature of the central pin 108 described above. The commutator 102 further defines a bore 105 that is configured to receive an end of a drive link (such as for example an end of the drive link 90 shown in FIG. 9). Accordingly, when the drive link rotates, thereby imparting rotation to the commutator 102, the central pin 108 in turn rotates within the pin hole 160 in the end cover 150. In addition, as referenced above, the central pin 108 is offset relative to the center axis longitudinal axis "A" of the commutator 102. Accordingly, when the commutator rotates with the central pin located in the pin hole of the end cover, the resultant motion is an eccentric rotation of commutator porting comparably as in the first embodiment.

The fluid communication portion 154 of the end cover 150 may include fluid porting and passages for communicating hydraulic fluid to and from the other components of the commutator/manifold assembly 100. In particular, the end cover 150 may include a first pressure side port 162 that opens into a first pressure side passage 164. Such components provide a hydraulic fluid flow in communication with the first pressure side porting of the commutator/manifold assembly described previously. A first pressure side fluid connector 166 may be connected to the first pressure side port 162 for an external fluid connection to the commutator/manifold assembly on the first pressure side. Similarly, the end cover may include a second pressure side port 168 that opens into a second pressure side passage 170. Such components provide a hydraulic fluid flow in communication with the second pressure side porting of the commutator/manifold assembly described previously. A second first pressure side fluid connector 172 may be connected to the second pressure side port 168 for an external fluid connection to the commutator/manifold assembly on the second pressure side. Again, as referenced above, in exemplary embodiments the first pressure side may be a low case pressure that permits a return flow through the commutator that has originated downstream from the motor rotor set. The second pressure side may be a high case pressure, that permits a forward flow through the commutator to the manifold and then to the motor rotor set. The pressures, however, may be reversed such that the first pressure is the high pressure side and the second pressure is the low pressure side, in which case the direction of the motor is reversed.

Due to the offset nature of the central pin 108, the operation of the commutator/manifold assembly 100 in controlling the fluid flow is comparable to that of the commutator/manifold assembly 60 of the previous embodiments. The overall flow occurs as follows. In a typical example, the outer porting 126 is on the high pressure side, and the inner commutator ports 118 are on the low pressure side, with the commutator seal isolating the two pressure sides from each other as described above. A supply flow on the high pressure side originates in the second side fluid connector 172, which flows through the end cover 150 via the second pressure side port 168 and second pressure side passage 170. The rotation of the commutator 102 and simultaneous orbiting of the commutator ports within the commutator ring 120 results in a timed alignment on the high pressure side of the outer commutator porting 126 with a portion of the manifold ports 138. Hydraulic fluid, therefore, flows in a straight configuration, without directional restriction, through the manifold ports 138 into a portion of the motor pockets formed within the motor rotor set.

On the low pressure side, the rotation of the commutator 102 and simultaneous orbiting of the commutator ports within the commutator ring 103 results in a timed alignment of the inner commutator ports 118 with a different portion of the manifold ports 138. A return flow of hydraulic fluid, therefore, flows in a straight configuration, again without directional restriction, through the manifold ports 138 from a portion of low pressure motor pockets formed within the motor rotor set. A return flow on the low pressure side flows out through the end cover 150 via the first side fluid passage 164 and first side fluid port 162, and out through the first side fluid connector 166. The pressure differential results in rotation of the motor rotor set, with a timed expanding and contraction of the motor pockets. The rotation of the rotor set drives rotation of an output shaft, which in turn may drive any suitable output element that may be connected to the output shaft (e.g., wheel axle, gear box, rotating fan, or other suitable usage). One way to reverse the motor direction is to reverse the high pressure side and low pressure side of the fluid flow through the commutator porting.

As referenced in connection with the previous embodiment, the first embodiment of FIGS. 1-10 may achieve a reverse flow instead by flipping the commutator (instead of providing a reverse timing manifold). In the pin configuration of FIGS. 11-16, flipping the commutator is no longer an option so a standard timing commutator and a reverse timing commutator may be employed. The embodiment of FIGS. 11-15 can be advantageous in that the outer porting need not be defined within the commutator itself, making the commutator component 102 easier to manufacture as compared to the commutator component 10 of the first embodiment.

An aspect of the invention is a commutator/manifold assembly configured to control a flow of hydraulic fluid to and from a hydraulic motor in a hydraulic fluid system. In exemplary embodiments, the commutator/manifold assembly includes a commutator having an offset design including a radially inner portion eccentrically encompassed within a radially outer portion, and commutator porting configured for a flow of hydraulic fluid through the commutator; and a manifold including a plurality of manifold ports, the manifold ports having a straight configuration by which walls defining the manifold ports run at a constant angle along a longitudinal axis through an entirety of the manifold. The commutator is configured to rotate to sequentially align the commutator porting with differing portions of the manifold ports to control a flow of hydraulic fluid through the commutator/manifold assembly. The commutator/manifold assembly may include one or more of the following features, either individually or in combination.

In an exemplary embodiment of the commutator/manifold assembly, the inner portion of the commutator comprises a plurality of supports that define a plurality of inner ports of the commutator porting, the inner ports being positioned eccentrically off center relative to a rotational axis of the commutator.

In an exemplary embodiment of the commutator/manifold assembly, the plurality of supports comprises a plurality of radial supports that extend from an inner ring support.

In an exemplary embodiment of the commutator/manifold assembly, the outer portion of the commutator defines at least one outer port of the commutator porting, and the inner ports are isolated from the at least one outer port.

In an exemplary embodiment of the commutator/manifold assembly, the commutator/manifold assembly further includes a commutator seal received within a groove defined by the commutator, the commutator seal being configured to isolate the inner ports from the outer ports.

In an exemplary embodiment of the commutator/manifold assembly, the inner ports comprise a first pressure side configured to receive a flow of hydraulic fluid at a first pressure, and the at least one outer commutator port comprises a second pressure side configured to receive a flow of hydraulic fluid at a second pressure different from the first pressure.

In an exemplary embodiment of the commutator/manifold assembly, the second pressure side is a high pressure side relative to the first pressure side.

In an exemplary embodiment of the commutator/manifold assembly, the commutator defines a central bore that is centrally positioned relative to an outer diameter of the commutator, the central bore being configured to receive a drive link that drives the rotation of the commutator.

In an exemplary embodiment of the commutator/manifold assembly, the manifold defines a central manifold bore that is aligned with the central bore of the commutator to receive the drive link.

In an exemplary embodiment of the commutator/manifold assembly, the inner portion of the commutator has a greater thickness in an axial direction than the outer portion of the commutator.

In an exemplary embodiment of the commutator/manifold assembly, the manifold ports have an elongated cross-sectional shape having a width in a radial direction that is smaller than a length in a circumferential direction around the longitudinal axis.

In an exemplary embodiment of the commutator/manifold assembly, the commutator/manifold assembly further includes a commutator ring having a guiding surface configured to guide the rotation of the commutator.

In an exemplary embodiment of the commutator/manifold assembly, the commutator ring includes a main flow port configured to be in fluid communication with the at least one outer port of the commutator porting.

In an exemplary embodiment of the commutator/manifold assembly, the commutator/manifold assembly further includes a fluid pathway including in fluid communication the main flow port, a gap defined by the guiding surface of the commutator ring and the outer portion of the commutator, and the at least one outer port of the commutator porting.

In an exemplary embodiment of the commutator/manifold assembly, the offset design of the commutator comprises a central pin that is located offset relative to a longitudinal axis of the commutator.

In an exemplary embodiment of the commutator/manifold assembly, the commutator/manifold assembly further includes an end cover positioned on an opposite side of the commutator relative to the manifold; wherein the end cover defines a pin hole for receiving the central pin of the commutator; and wherein when the commutator rotates, the central pin rotates within the pin hole such that the commutator porting rotates eccentrically relative to the longitudinal axis of the commutator.

In an exemplary embodiment of the commutator/manifold assembly, the end cover comprises fluid porting and passages for communicating a forward flow to and a return flow from the commutator.

In an exemplary embodiment of the commutator/manifold assembly, the commutator/manifold assembly further includes a commutator ring configured to guide the rotation of the commutator, wherein the commutator ring has an inner surface and the inner surface of the commutator ring and the outer surface of the commutator define the at least one outer port.

In an exemplary embodiment of the commutator/manifold assembly, the commutator ring includes a main flow port configured to be in fluid communication with the at least one outer port.

In an exemplary embodiment of the commutator/manifold assembly, a cross-sectional shape of the manifold ports is constant along a longitudinal axis through an entirety of the manifold.

In an exemplary embodiment of the commutator/manifold assembly, the manifold ports are flared or narrowing from one side of the manifold to an opposite side of the manifold.

In an exemplary embodiment of the commutator/manifold assembly, the manifold ports have different shapes on opposite sides of the manifold.

Another aspect of the invention is a hydraulic motor assembly that includes the commutator/manifold assembly of any of the embodiments, and a hydraulic motor. The rotation of the commutator provides a timed flow of hydraulic through the manifold ports to the motor and a return flow from the motor. The hydraulic motor assembly may include one or more of the following features, either individually or in combination.

In an exemplary embodiment of the hydraulic motor assembly, the motor has a gerotor configuration including an inner rotor set configured to rotate in a stator, the rotor set and the stator defining a plurality of motor pockets; and rotation of the commutator results in a timed alignment of the commutator porting with the manifold ports so as to provide a timed flow of hydraulic fluid to the motor pockets to maintain the rotation of the rotor set.

In an exemplary embodiment of the hydraulic motor assembly, the hydraulic motor assembly further includes a drive link operable to control a rotational positioning of the commutator.

Another aspect of the invention is a commutator configured to control a flow of hydraulic fluid in a hydraulic fluid system. In exemplary embodiments, the commutator is configured with an offset design comprising a radially inner portion eccentrically encompassed within a radially outer portion, and commutator porting configured for a flow of hydraulic fluid through the commutator; the commutator porting being offset relative to a center axis of the commutator. The commutator may include one or more of the following features, either individually or in combination.

In an exemplary embodiment of the commutator, the inner portion of the commutator comprises a plurality of supports that define a plurality of inner ports of the commutator porting, the inner ports being positioned eccentrically off center relative to the center axis of the commutator.

In an exemplary embodiment of the commutator, the plurality of supports comprises a plurality of radial supports that extend from an inner ring support.

In an exemplary embodiment of the commutator, the outer portion of the commutator defines at least one outer port of the commutator porting, and the inner ports are isolated from the at least one outer port.

In an exemplary embodiment of the commutator, the commutator further includes a commutator seal received within a groove defined by the commutator, the commutator seal being configured to isolate the inner ports from the outer ports.

In an exemplary embodiment of the commutator, the commutator defines a central bore that is centrally positioned relative to an outer diameter of the commutator, the central bore being configured to receive a drive link that drives rotation of the commutator.

In an exemplary embodiment of the commutator, the inner portion of the commutator has a greater thickness in an axial direction than the outer portion of the commutator.

In an exemplary embodiment of the commutator, the offset design of the commutator comprises a central pin that is located offset relative to a longitudinal axis of the commutator.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A commutator/manifold assembly configured to control a flow of hydraulic fluid to and from a hydraulic motor in a hydraulic fluid system, the commutator/manifold assembly comprising:

a commutator having a central bore that is centrally positioned relative to an outer diameter of the commutator about a rotational axis of the commutator, an inner portion that defines a plurality of inner ports that are positioned eccentrically off center relative to the rotational axis, and an outer portion defining at least one outer port that is positioned radially outward from the rotational axis relative to the plurality of inner ports, the plurality of inner ports and the at least one outer port form a commutator porting being configured for a flow of hydraulic fluid through the commutator; and a manifold including a plurality of manifold ports, the manifold ports having a straight configuration by which walls defining the manifold ports run substantially parallel to a longitudinal axis through an entirety of the manifold;

wherein the commutator is configured to rotate to sequentially align the commutator porting with differing portions of the manifold ports to control a flow of hydraulic fluid through the commutator/manifold assembly.

2. The commutator/manifold assembly of claim 1, wherein the inner portion of the commutator comprises a plurality of supports that define the plurality of inner ports.

3. The commutator/manifold assembly of claim 2, wherein the plurality of supports comprises a plurality of radial supports that extend from an inner ring support.

4. The commutator/manifold assembly claim 2, wherein the inner ports are isolated from the at least one outer port.

5. The commutator/manifold assembly of claim 4, further comprising a commutator seal received within a groove defined by the commutator, the commutator seal being configured to isolate the inner ports from the at least one outer port.

6. The commutator/manifold assembly of claim 4, wherein the inner ports comprise a first pressure side configured to receive a flow of hydraulic fluid at a first pressure, and the at least one outer port comprises a second pressure side configured to receive a flow of hydraulic fluid at a second pressure different from the first pressure, the second pressure side is a high pressure side relative to the first pressure side.

7. The commutator/manifold assembly of claim 1, wherein the central bore is configured to receive a drive link that drives the rotation of the commutator.

8. The commutator/manifold assembly of claim 7, wherein the manifold defines a central manifold bore that is aligned with the central bore of the commutator to receive the drive link.

9. The commutator/manifold assembly of claim 1, wherein the inner portion of the commutator has a greater thickness in an axial direction than the outer portion of the commutator.

10. The commutator/manifold assembly of claim 1, wherein the manifold ports have an elongated cross-sectional shape having a width in a radial direction that is smaller than a length in a circumferential direction around the longitudinal axis.

11. The commutator/manifold assembly of claim 1, further comprising a commutator ring having a guiding surface configured to guide the rotation of the commutator.

12. The commutator/manifold assembly of claim 11, wherein the commutator ring includes a main flow port configured to be in fluid communication with the at least one outer port of the commutator porting.

13. The commutator/manifold assembly of claim 12 comprising a fluid pathway including in fluid communication the main flow port, a gap defined by the guiding surface of the commutator ring and the outer portion of the commutator, and the at least one outer port of the commutator porting.

14. The commutator/manifold assembly of claim 1, wherein the manifold ports are flared or narrowing from one side of the manifold to an opposite side of the manifold.

15. A hydraulic motor assembly comprising:

the commutator/manifold assembly of claim 1; and a hydraulic motor;

wherein the rotation of the commutator provides a timed flow of hydraulic through the manifold ports to the motor and a return flow from the motor.

16. The hydraulic motor assembly of claim 15, wherein:

the motor has a gerotor configuration including an inner rotor set configured to rotate in a stator, the rotor set and the stator defining a plurality of motor pockets; and rotation of the commutator results in a timed alignment of the commutator porting with the manifold ports so as to provide a timed flow of hydraulic fluid to the motor pockets to maintain the rotation of the rotor set.

* * * * *